US011117374B2

(12) United States Patent
Nakagawa et al.

(10) Patent No.: US 11,117,374 B2
(45) Date of Patent: Sep. 14, 2021

(54) LIQUID EJECTION HEAD AND LIQUID EJECTION APPARATUS

(71) Applicant: CANON KABUSHIKI KAISHA, Tokyo (JP)

(72) Inventors: Yoshiyuki Nakagawa, Kawasaki (JP); Kazuhiro Yamada, Yokohama (JP); Shingo Okushima, Kawasaki (JP); Yasuhiko Osaki, Kamakura (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 16/590,110

(22) Filed: Oct. 1, 2019

(65) Prior Publication Data

US 2020/0108604 A1 Apr. 9, 2020

(30) Foreign Application Priority Data

Oct. 5, 2018 (JP) ..... JP2018-190402

(51) Int. Cl.
*B41J 2/14* (2006.01)

(52) U.S. Cl.
CPC ..... *B41J 2/1433* (2013.01); *B41J 2/14016* (2013.01); *B41J 2002/14419* (2013.01)

(58) Field of Classification Search
CPC ..... B41J 2/1433; B41J 2/14016; B41J 2002/14419
See application file for complete search history.

(56) References Cited

U.S. PATENT DOCUMENTS

2017/0197433 A1* 7/2017 Nakagawa ..... B41J 2/18
2017/0197437 A1* 7/2017 Okushima ..... B41J 2/17563

FOREIGN PATENT DOCUMENTS

JP 2002-355973 A 12/2002

* cited by examiner

*Primary Examiner* — Justin Seo
(74) *Attorney, Agent, or Firm* — Canon U.S.A., Inc. IP Division

(57) ABSTRACT

A liquid ejection head includes an ejection orifice for ejecting a liquid; a flow path in which an energy generating element is disposed, generates an energy to be used for ejecting the liquid; a liquid inside the flow path; an ejection orifice part that allows the ejection orifice and the flow path to communicate with each other; a supply flow path for supplying the liquid from the outside; and a recovery flow path for recovering the liquid to the outside. The moisture content of the liquid is 65 wt % or less. The liquid inside the flow path is circulated between the inside and the outside of the flow path.

17 Claims, 33 Drawing Sheets

LIQUID EJECTION HEAD AND LIQUID EJECTION APPARATUS

BACKGROUND

Field of the Disclosure

The present disclosure generally relates to a liquid ejection head and a liquid ejection apparatus capable of ejecting an ink from an ejection orifice.

Description of the Related Art

In liquid ejection heads to be used for an ink jet recording apparatus that ejects a liquid, such as ink, to form an image, as a volatile component in ink evaporates from an ejection orifice for ejecting the ink, the ink in the vicinity of the ejection orifice is increased in viscosity. Accordingly, the ejection speed of a droplet to be ejected changes or landing accuracy is affected. This is particularly true in a case where the pause time after the ejection is performed is long, there are also cases where an increase in the viscosity of the ink becomes pronounced, the solid component of the ink adheres to the vicinity of the ejection orifice, and the flow resistance of the ink is increased by this solid component, which results in ejection failure.

As one of the measures against such a viscosity increase phenomenon of the ink, a method of circulating the ink to be supplied to a liquid ejection head through a circulation path is known. Japanese Patent Application Laid-Open No. 2002-355973 discloses a liquid ejection head that prevents clogging of an ejection orifice accompanying evaporation of ink from the ejection orifice by circulating the ink within a flow path formed between a member in which the ejection orifice is formed, and a substrate in which a heating resistor is formed.

SUMMARY

The present disclosure is directed to a liquid ejection head including an ejection orifice for ejecting a liquid; a flow path in which an energy generating element, which generates an energy to be used for ejecting the liquid, is disposed; a liquid inside the flow path; an ejection orifice part that allows the ejection orifice and the flow path to communicate with each other; a supply flow path for supplying the liquid from the outside; and a recovery flow path for recovering the liquid to the outside. The moisture content of the liquid is 65 wt % or less. The liquid inside the flow path is circulated between the inside and the outside of the flow path. In a case where a height of the flow path on an upstream side in a flow direction of the liquid within the flow path is H [μm], a length of the ejection orifice part in a direction in which the liquid is ejected from the ejection orifice is P [μm], and a length of the ejection orifice part in the flow direction of the liquid within the flow path is W [μm] in a communication part between the flow path and the ejection orifice part, $H^{-0.34} \times P^{-0.66} \times W > 1.5$ is satisfied.

Further features of the present disclosure will become apparent from the following description of exemplary embodiments with reference to the attached drawings.

DESCRIPTION OF THE EMBODIMENTS

As a result of the present inventors' study, a new problem was found that, in the circulation of ink according to the configuration of Japanese Patent Application Laid-Open No. 2002-355973, since the measure against the increase in viscosity of the ink resulting from the evaporation of the ink from the ejection orifice is not sufficient, the coloring material concentration of the ink changes, and color unevenness occurs when an image is formed. Particularly, in the case of ink with a small moisture content, the increase in viscosity accompanying the evaporation becomes large. Therefore, the color unevenness of the image occurs easily.

In view of the above problem, the present disclosure provides a liquid ejection head and a liquid ejection apparatus that reduce occurrence of the color unevenness in an image to be formed due to an increase in viscosity of ink resulting from evaporation of the ink from an ejection orifice.

Hereinafter, embodiments of the disclosure will be described with reference to the drawings. However, the following description does not limit the scope of the present disclosure. As one example, a thermal system of generating a bubble by a heat generating element to eject the liquid has been adopted in the present embodiment. However, the present disclosure can also be applied to liquid ejection heads in which a piezoelectric system and other various liquid ejection systems are adopted.

The present embodiment is an ink jet recording apparatus of a form in which the liquid, such as ink, is circulated between a tank and the liquid ejection head. However, other forms may be adopted. For example, a form may be adopted in which the ink within a pressure chamber is made to flow without circulating the ink by providing two tanks on an upstream side and a downstream side of the liquid ejection head and causing the ink to flow from one tank to the other tank.

Additionally, the present embodiment is a so-called line-type head having a length corresponding to the width of a recording medium. However, the present disclosure can also be applied to a so-called serial liquid ejection head that performs recording while performing scanning with respect to the recording medium. The serial liquid ejection head includes, for example, a configuration in which one recording element substrate for black ink and one recording element substrate for color ink are mounted. However, the serial liquid ejection head is not limited to this. There may be adopted a form in which a short line head that has a plurality of recording element substrates disposed such that ejection orifices overlap each other in an ejection orifice line direction, and is shorter than the width of a recording medium is created, and the liquid ejection head is made to scan the recording medium.

(Description of Ink Jet Recording Apparatus)

Figure 1:
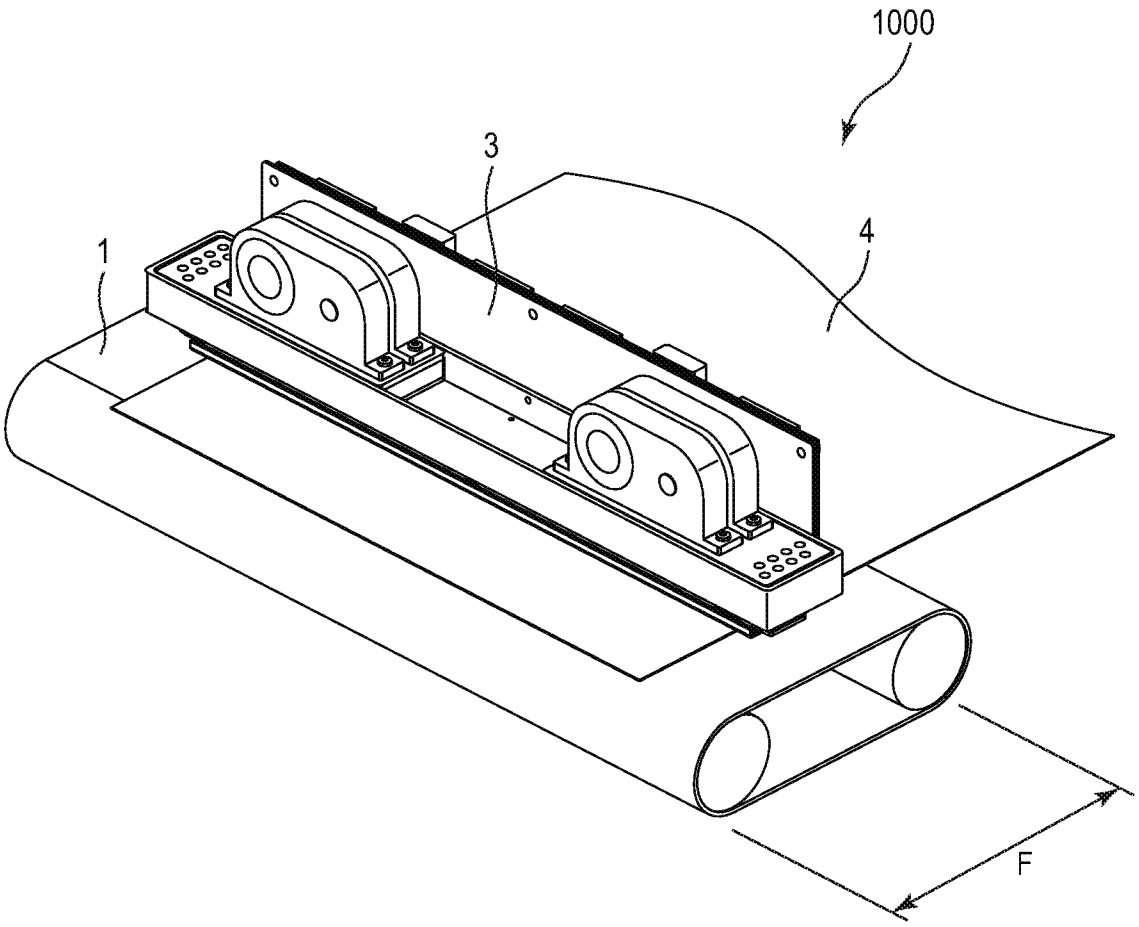
FIG. 1 is a perspective view illustrating a schematic configuration of a liquid ejection apparatus.

A schematic configuration of a liquid ejection apparatus that ejects a liquid, especially an ink jet recording apparatus (hereinafter also referred to as a "recording apparatus") 1000 that ejects ink to perform recording is illustrated in FIG. 1. The recording apparatus 1000 includes a conveying unit 1 that conveys a recording medium 4, and a line-type (page-wide type) liquid ejection head 3 that is disposed to be substantially orthogonal to a conveying direction of the recording medium 4. Also, the recording apparatus is a line-type recording apparatus that performs one-pass continuous recording while continuously or intermittently conveying a plurality of the recording media 4. The recording medium 4 is not limited to a cut sheet, and may be continuous roll paper. The liquid ejection head 3 is capable of performing (cyan, magenta, yellow, black) full color printing by CMYK inks. Additionally, as will be described below, a liquid supply unit that is a supply path for supplying the liquid to the liquid ejection head, a main tank, and a buffer tank (refer to FIG. 2) are fluidly connected to the liquid ejection head. Additionally, an electrical control unit, which transmits electrical power and an ejection control signal to the liquid ejection head 3, is electrically connected to the liquid ejection head 3. A liquid path and an electrical-signal path within the ejection head 3 will be described below.

(Description of First Circulation Path)

Figure 2:
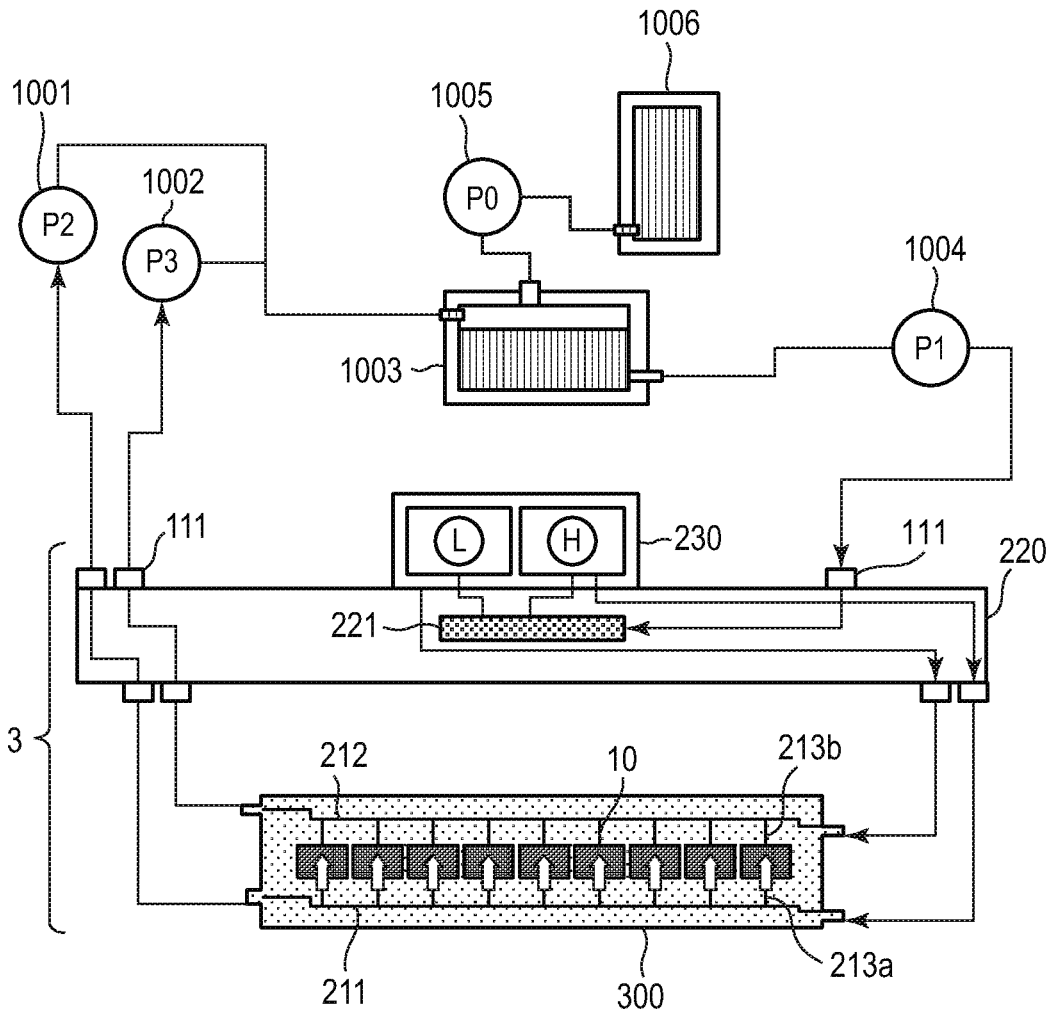
FIG. 2 is a view illustrating a first circulation flow path of the liquid ejection apparatus illustrated in FIG. 1.

FIG. 2 is a schematic view illustrating a first circulation path that is one form of a circulation path to be applied to the recording apparatus of the present embodiment, and is a view in which the liquid ejection head 3 is fluidly connected to a first circulation pump (high-pressure side) 1001, a first circulation pump (low-pressure side) 1002, a buffer tank 1003, and the like. In addition, in FIG. 2, in order to simplify the description, only a path along which one color ink among CMYK inks flows is illustrated. However, circulation paths equivalent to the four colors are provided in practice in the liquid ejection head 3 and a recording apparatus body. The buffer tank 1003 serving as a subtank, which is connected to the main tank 1006, has an ambient air communication port (not illustrated) that allows the inside and the outside of the tank to communicate with each other, and is capable of discharging the bubble in the ink to the outside. The buffer tank 1003 is also connected to a replenishment pump 1005. When the liquid is consumed by the liquid ejection head 3 by ejecting (discharging) the ink from the ejection orifice of the liquid ejection head 3, such as recording or suction recovery by ejecting the ink, the replenishment pump 1005 transfers the ink of the consumed amount from the main tank 1006 to the buffer tank 1003.

The two first circulation pumps 1001 and 1002 have a role of drawing out the liquid from a liquid connection unit 111 of the liquid ejection head 3 to cause the liquid to flow to the buffer tank 1003. A positive-displacement pump having a quantitative liquid delivery capability can be preferably used as a first circulation pump. Specifically, the first circulation pump includes a tube pump, a gear pump, a diaphragm pump, a syringe pump, or the like. However, the first circulation pump can be used in, for example, a form in which a general constant flow rate valve or a general relief valve is disposed in a pump outlet to secure a constant flow rate. When a liquid ejection unit 300 is driven, a certain amount of ink flows through a common supply flow path 211 and a common recovery flow path 212, respectively, by operating the first circulation pump (high-pressure side) 1001 and the first circulation pump (low-pressure side) 1002. The flow rate is preferably set to be equal to or more than a flow rate such that a temperature difference between respective recording element substrates 10 within the liquid ejection head 3 does not influence recording image quality. However, if an excessively large flow rate is set, due to influence of the pressure loss of the flow path within the liquid ejection unit 300, a negative pressure difference may be excessively large between the respective recording element substrates 10, and the density unevenness of an image may occur. For this reason, the flow rate is preferably set while taking into consideration the temperature difference and negative pressure difference between the respective recording element substrates 10.

A negative-pressure control unit 230 is provided in the path between the second circulation pump 1004 and the liquid ejection unit 300. Also, even in a case where the flow rate of the circulation system fluctuates due to a difference in duty at which recording is performed, the negative-pressure control unit 230 functions to operate so as to maintain the pressure on the downstream side (that is, the liquid ejection unit 300 side) of the negative-pressure control unit 230 within a preset certain pressure. As two pressure adjusting mechanisms which constitute the negative-pressure control unit 230, any mechanisms may be used as long as the pressure downstream of the negative-pressure control unit 230 itself can be controlled with a fluctuation equal to or lower than a certain range around a desired set pressure. As an example, the same mechanism as the so-called "pressure-reducing regulator" can be adopted. In a case where the pressure-reducing regulator is used, as illustrated in FIG. 2, an upstream side of the negative-pressure control unit 230 is preferably pressurized via a liquid supply unit 220 by the second circulation pump 1004. By doing so, the influence of the head pressure of the buffer tank 1003 on the liquid ejection head 3 can be suppressed. Thus, the degree of freedom of the layout of the buffer tank 1003 in the recording apparatus 1000 can be extended. As the second circulation pump 1004, a turbo type pump, a positive-displacement pump, or the like can be used as long as a head pressure equal to or more than a certain pressure is provided within a range of an ink circulation flow rate to be used when the liquid ejection head 3 is driven. Specifically, a diaphragm pump or the like is applicable. Additionally, instead of the second circulation pump 1004, for example, a head tank disposed with a certain head difference with respect to the negative-pressure control unit 230 is also applicable.

As illustrated in FIG. 2, the negative-pressure control unit 230 includes the two pressure adjusting mechanisms that are respectively set to have mutually different control pressures. A higher-pressure setting side (denoted by H in FIG. 2) and a lower-pressure side (denoted by L in FIG. 2) of the two negative-pressure adjusting mechanisms are respectively connected to the common supply flow path 211 and the common recovery flow path 212 within the liquid ejection unit 300 via the inside of the liquid supply unit 220. The liquid ejection unit 300 is provided with the common supply flow path 211, the common recovery flow path 212, and an individual supply flow path 213*a* and an individual recovery flow path 213*b* that communicate with each recording element substrate. Since the individual flow paths 213 communicate with the common supply flow path 211 and the common recovery flow path 212, respectively, a flow (arrow of FIG. 2) in which a portion of the liquid passes through the internal flow path of the recording element substrate 10 from the common supply flow path 211 and flows into the common recovery flow path 212 is generated. This is because a pressure difference is caused between the two common flow paths since the pressure adjusting mechanism H is connected to the common supply flow path 211 and the pressure adjusting mechanism L is connected to the common recovery flow path 212.

In this way, in the liquid ejection unit 300, such a flow that a portion of the liquid passes through each recording element substrate 10 while the liquid is caused to pass through the common supply flow path 211 and the common recovery flow path 212, respectively, is generated. For this reason, the heat generated in each recording element substrate 10 can be discharged to the outside of the recording element substrate 10 due to the flow of the common supply flow path 211 and the common recovery flow path 212. Additionally, by virtue of such a configuration, the flow of the ink can be caused even in the ejection orifice or a pressure chamber that does not perform recording, when recording is performed by the liquid ejection head 3. Thus, the increase in viscosity of the ink can be suppressed in that part. Additionally, the viscosity-increased ink or foreign matter in the ink can be discharged to the common recovery flow path 212. For this reason, the liquid ejection head 3 enables high-speed and high-quality recording.

(Description of Second Circulation Path)

Figure 3:
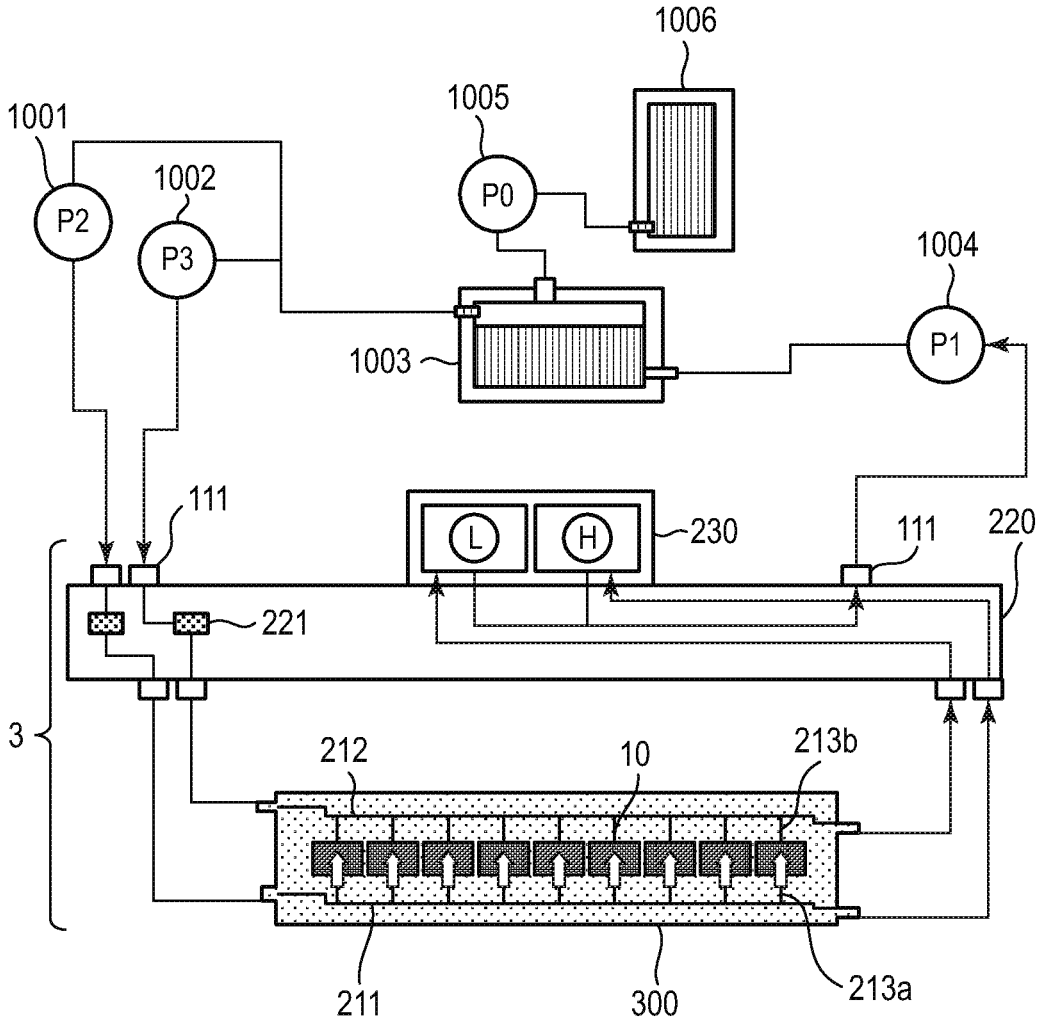
FIG. 3 is a view illustrating a second circulation flow path of the liquid ejection apparatus illustrated in FIG. 1.

FIG. 3 is a schematic view illustrating a second circulation path that is a circulation form different from the above-described first circulation path in the circulation path to be applied to the recording apparatus of the present embodiment. A main difference from the aforementioned first circulation path is the two pressure adjusting mechanisms that constitute the negative-pressure control unit 230. Both the pressure adjusting mechanisms are mechanisms (a mechanism component of the same function as that of a so-called "back-pressure regulator") that control the pressure upstream of the negative-pressure control unit 230 with a fluctuation within a certain range around a desired set pressure. In addition, there is a point that the second circulation pump 1004 functions as a negative pressure source that decompresses the downstream side of the negative-pressure control unit 230. Additionally, another difference is that the first circulation pump (high-pressure side) 1001 and the first circulation pump (low-pressure side) 1002 are disposed on the upstream side of the liquid ejection head, and the negative-pressure control unit 230 is disposed on the downstream side of the liquid ejection head.

There is a case where the fluctuation of the flow rate is caused due to a change in recording duty when recording is performed by the liquid ejection head 3. Even in this case, the negative-pressure control unit 230 functions to stabilize the pressure fluctuation on the upstream side (that is, the liquid ejection unit 300 side) of the negative-pressure control unit 230 within a certain range around a preset pressure. As illustrated in FIG. 3, the downstream side of the negative-pressure control unit 230 is preferably pressurized via the liquid supply unit 220 by the second circulation pump 1004. In this way, since the influence of the head pressure of the buffer tank 1003 on the liquid ejection head 3 can be suppressed, the range of choice of the layout of the buffer tank 1003 in the recording apparatus 1000 can be widened. Instead of the second circulation pump 1004, for example, a head tank disposed with a predetermined head difference with respect to the negative-pressure control unit 230 is also applicable.

Similarly to the previous embodiment, as illustrated in FIG. 3, the negative-pressure control unit 230 includes the two pressure adjusting mechanisms that are respectively set to have mutually different control pressures. The higher-pressure setting side (denoted by H in FIG. 3) and the lower-pressure side (denoted by L in FIG. 3) of the two negative-pressure adjusting mechanisms are respectively connected to the common supply flow path 211 and the common recovery flow path 212 within the liquid ejection unit 300 via the inside of the liquid supply unit 220. The pressure of the common supply flow path 211 is made relatively higher than the pressure of the common recovery flow path 212 by the two negative-pressure adjusting mechanisms. By doing this, an ink flow that flows from the common supply flow path 211 via the individual flow path 213 and the internal flow path of each recording element substrate 10 to the common recovery flow path 212 is generated (arrow of FIG. 3). In this way, in the second circulation path, the same ink flow state as that of the first circulation path is obtained within the liquid ejection unit 300. However, there are two advantages different from those in the case of the first circulation path.

The first advantage is that, in the second circulation path, since the negative-pressure control unit 230 is disposed on the downstream side of the liquid ejection head 3, there is little concern that dust or foreign matter generated from the negative-pressure control unit 230 flows into the head. The second advantage is that, in the second circulation path, the maximum value of a required flow rate to be supplied from the buffer tank 1003 to the liquid ejection head 3 is smaller than that in the case of the first circulation path. The reason is as follows. The sum of flow rates within the common supply flow path 211 and the common recovery flow path 212 in a case where the ink is circulated in a recording standby mode is referred to as A. The value of the A is defined as a minimum flow rate required in order to keep a temperature difference within the liquid ejection unit 300 within a required range in a case where the temperature adjustment of the liquid ejection head 3 is performed during recording standby. Additionally, the ejection flow rate in a case where the ink is ejected from all the ejection orifices of the liquid ejection unit 300 (full ejection mode) is defined as F. If so, in the case of the first circulation path (FIG. 2), the set flow rate of the first circulation pump (high-pressure side) 1001 and the first circulation pump (low-pressure side) 1002 becomes A. Thus the maximum value of the amount of supply of the liquid to the liquid ejection head 3 required in the full ejection mode becomes A+F.

On the other hand, in the case of the second circulation path (FIG. 3), the amount of supply of the liquid to the liquid ejection head 3 required in the recording standby mode is the flow rate A. Also, the amount of supply of the liquid to the liquid ejection head 3 required in the full ejection mode becomes the flow rate F. If so, in the case of the second circulation path, a total value of the set flow rates of the first circulation pump (high-pressure side) 1001 and the first circulation pump (low-pressure side) 1002, that is, a maximum value of a required supply flow rate, becomes a larger value of A or F. For this reason, as long as the liquid ejection unit 300 having the same configuration is used, the maximum value (A or F) of the required amount of supply in the second circulation path becomes smaller than the maximum value (A+F) of the required supply flow rate in the first circulation path. For that reason, in the case of the second circulation path, there are advantages that the degree of freedom of an applicable circulation pump can be increased, for example, a low-cost circulation pump having a simple configuration can be used or the load of a cooler (not illustrated) installed in a body-side path can be reduced. Accordingly, the cost of the recording apparatus body can be reduced. These advantages are greater for a line head in which the value of A or F becomes relatively larger and is useful for a line head of which the length in a longitudinal direction is longer among line heads.

However, on the other hand, there is also a point that the first circulation path is more advantageous than the second circulation path. That is, in the second circulation path, a flow rate that flows through the inside of the liquid ejection unit 300 is the maximum in the recording standby mode. Therefore, an image with a low recording duty area brings a state where a high negative pressure is applied to each nozzle. It is assumed that the head widths (the length of the liquid ejection head in a lateral direction) is made small particularly by making the flow path width (a length in a direction orthogonal to a flow direction of the liquid) of the common supply flow path 211 and the common recovery flow path 212 small. In this case, a high negative pressure is applied to a nozzle in the low-duty image of which the unevenness is easily visible. Therefore, there is a concern that the influence of satellite droplets may be increased. On the other hand, in the case of the first circulation path, a high negative pressure is applied to a nozzle when a high-duty image is formed. Therefore, there are advantages that visual recognition is not easy even if the satellites are generated, and the influence on the image is small. As the selection of these two circulation paths, a preferable selection can be adopted in the light of the specification (the ejection flow rate F, the minimum circulation flow rate A, and the flow path resistance within the head) of the liquid ejection head and the recording apparatus body.

(Description of Third Circulation Path)

Figure 29:
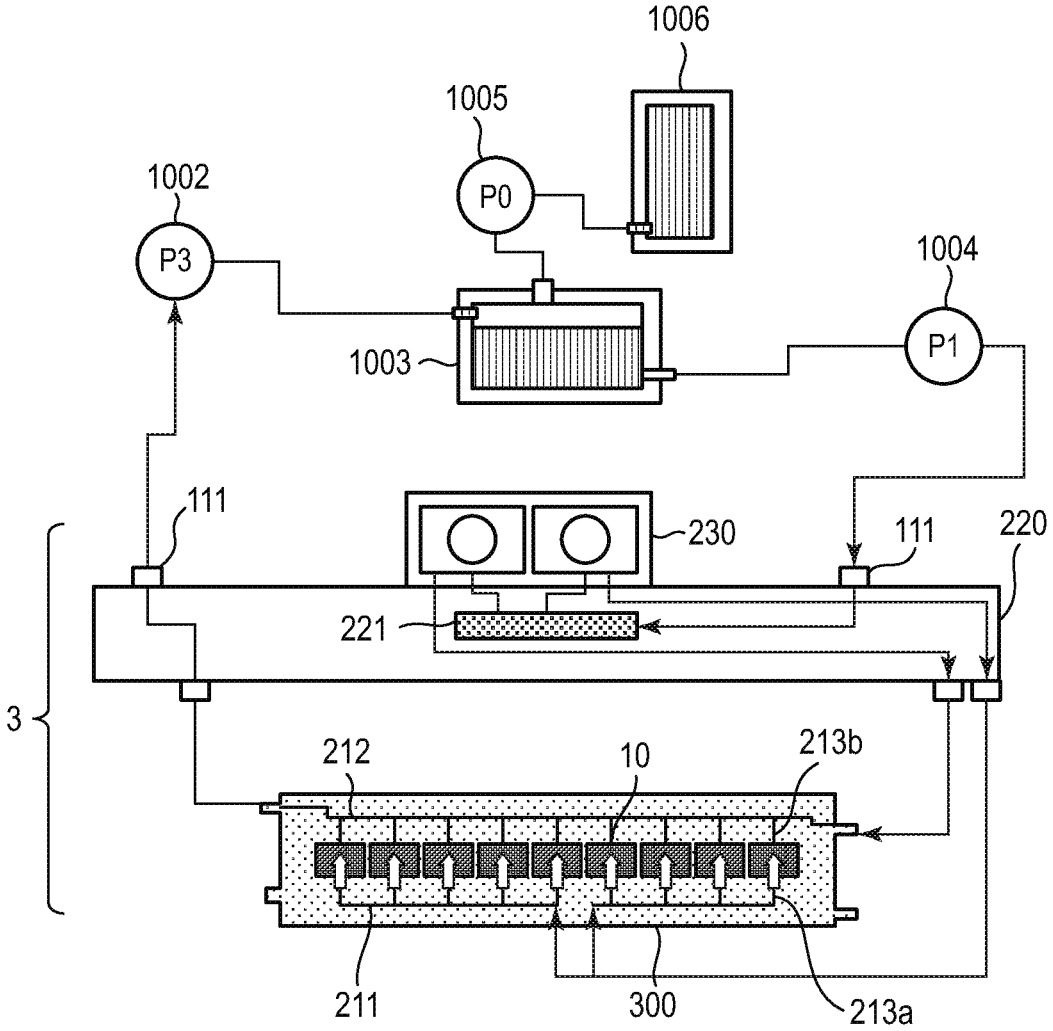
FIG. 29 is a view illustrating a circulation flow path of a liquid ejection apparatus.

FIG. 29 is a schematic view illustrating a third circulation path that is one form of a circulation path to be applied to the recording apparatus of the present embodiment. The description of the same functions and configurations as those of the above first and second circulation paths will be omitted, and differences will be actively described.

In the present circulation path, the liquid is supplied into the liquid ejection head 3 from a total of three of two spots of a central part of the liquid ejection head 3 and one end side of the liquid ejection head 3. After the liquid passes through each pressure chamber 23 from the common supply flow path 211, the liquid is recovered to the common recovery flow path 212, and is recovered from a recovery opening at the other end part of the liquid ejection head 3 to the outside. The individual flow paths 213 communicate with the common supply flow path 211 and the common recovery flow path 212, and the recording element substrate 10 and the pressure chamber 23 disposed within the recording element substrate are provided in the path of each individual flow path 213. Hence, a portion of the liquid that flows in the first circulation pump 1002 passes through the inside of the pressure chamber 23 of the recording element substrate 10 from the common supply flow path 211 and flows into the common recovery flow path 212 (arrow of FIG. 29). This is because a pressure difference is provided between the pressure adjusting mechanism H connected to the common supply flow path 211 and the pressure adjusting mechanism L connected to the common recovery flow path 212 and the first circulation pump 1002 is connected only to the common recovery flow path 212.

In this way, in the liquid ejection unit 300, a flow of the liquid, which passes through the inside of the common recovery flow path 212, and a flow, which passes through the pressure chamber 23 within each recording element substrate 10 from the common supply flow path 211 and flows into the common recovery flow path 212, are generated. For this reason, the heat generated in each recording element substrate 10 can be discharged to the outside of the recording element substrate 10 due to the flow from the common supply flow path 211 to the common recovery flow path 212 while an increase in pressure loss is suppressed. Additionally, according to the present circulation path, compared to the above first and second circulation paths, it is possible to reduce the number of pumps that are units for conveying the liquid.

(Description of Configuration of Liquid Ejection Head)

Figure 4A:
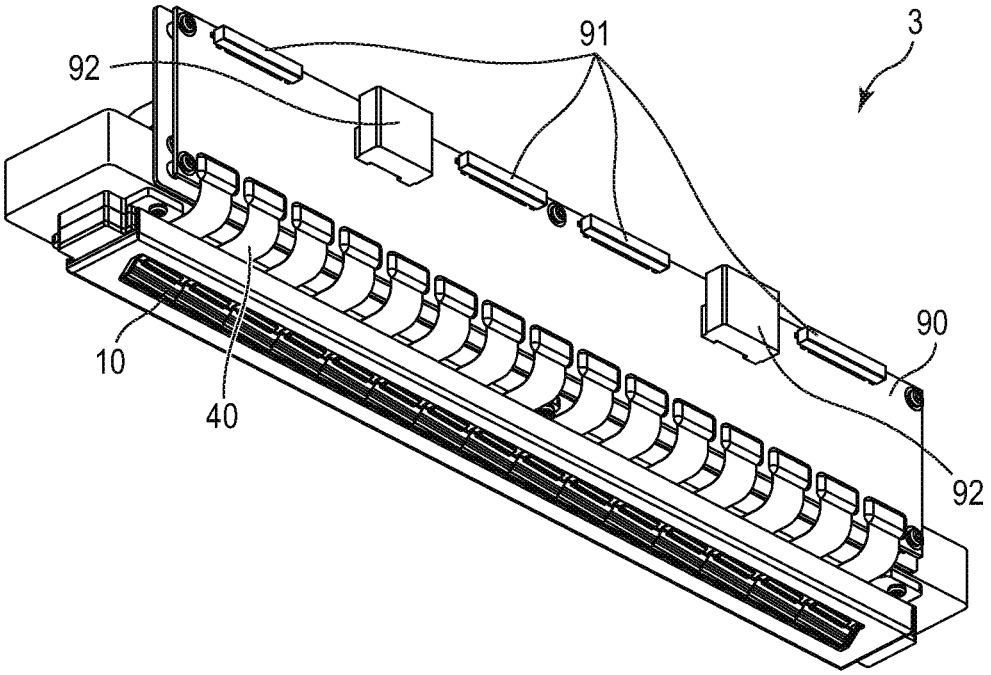
FIGS. 4A and 4B are perspective views of a liquid ejection head.
Figure 4B:
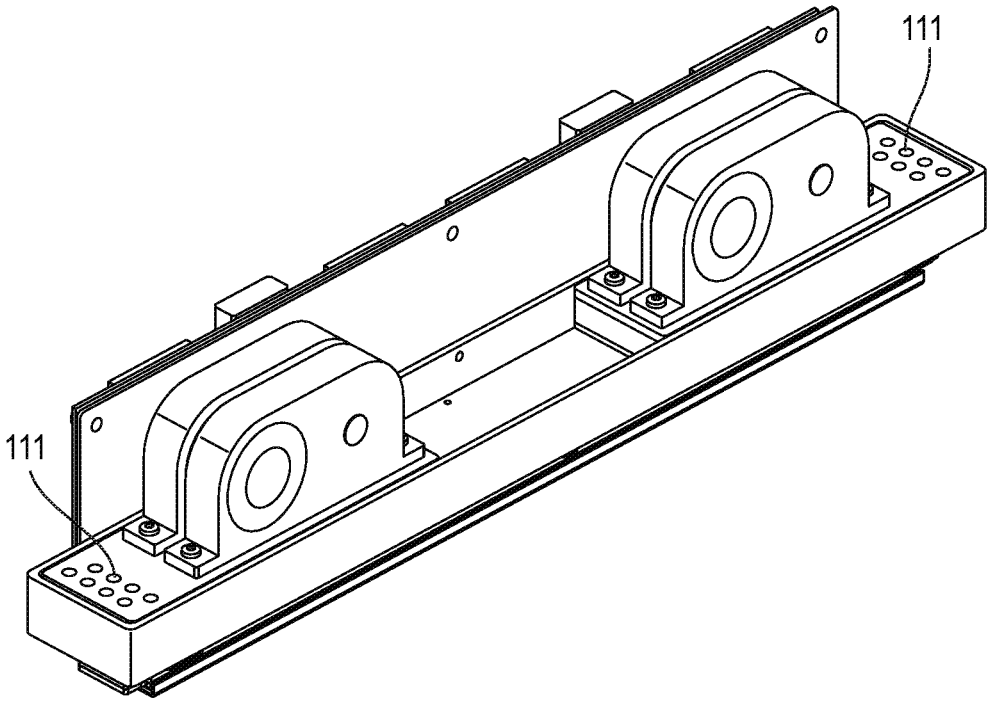

The configuration of the liquid ejection head 3 will be described. FIGS. 4A and 4B are perspective views of the liquid ejection head 3 related to the present embodiment. The liquid ejection head 3 is a line-type liquid ejection head in which fifteen recording element substrates 10 capable of ejecting the inks of the four colors of C/M/Y/K with one recording element substrate 10 are arranged (in-line) on a straight line. As illustrated in FIG. 4A, the liquid ejection head 3 includes a signal input terminal 91 and an electrical power supply terminal 92 that are electrically connected to each recording element substrate 10 via a flexible wiring substrate 40 and an electrical wiring substrate 90. The signal input terminal 91 and the electrical power supply terminal 92 are electrically connected to the control unit of the recording apparatus 1000, and respectively supply an ejection drive signal and electrical power required for ejection to the recording element substrate 10. By concentrating wiring lines by an electric circuit within the electrical wiring substrate 90, the number of signal output terminals 91 and the number of electrical power supply terminals 92 can be reduced compared to the number of recording element substrates 10. Accordingly, when the liquid ejection head 3 is assembled to the recording apparatus 1000 or when the liquid ejection head is replaced, the number of electrical connection parts that need to be removed is reduced. As illustrated in FIG. 4B, the liquid connection units 111 provided at both end parts of the liquid ejection head 3 are connected to the liquid supply system of the recording apparatus 1000. Accordingly, the inks of the four colors of CMYK are supplied from the supply system of the recording apparatus 1000 to the liquid ejection head 3. Additionally, the ink, which has passed through the liquid ejection head 3, is recovered to the supply system of the recording apparatus 1000. In this way, the inks of the respective colors are capable of being circulated via the path of the recording apparatus 1000, and the path of the liquid ejection head 3.

Figure 5:
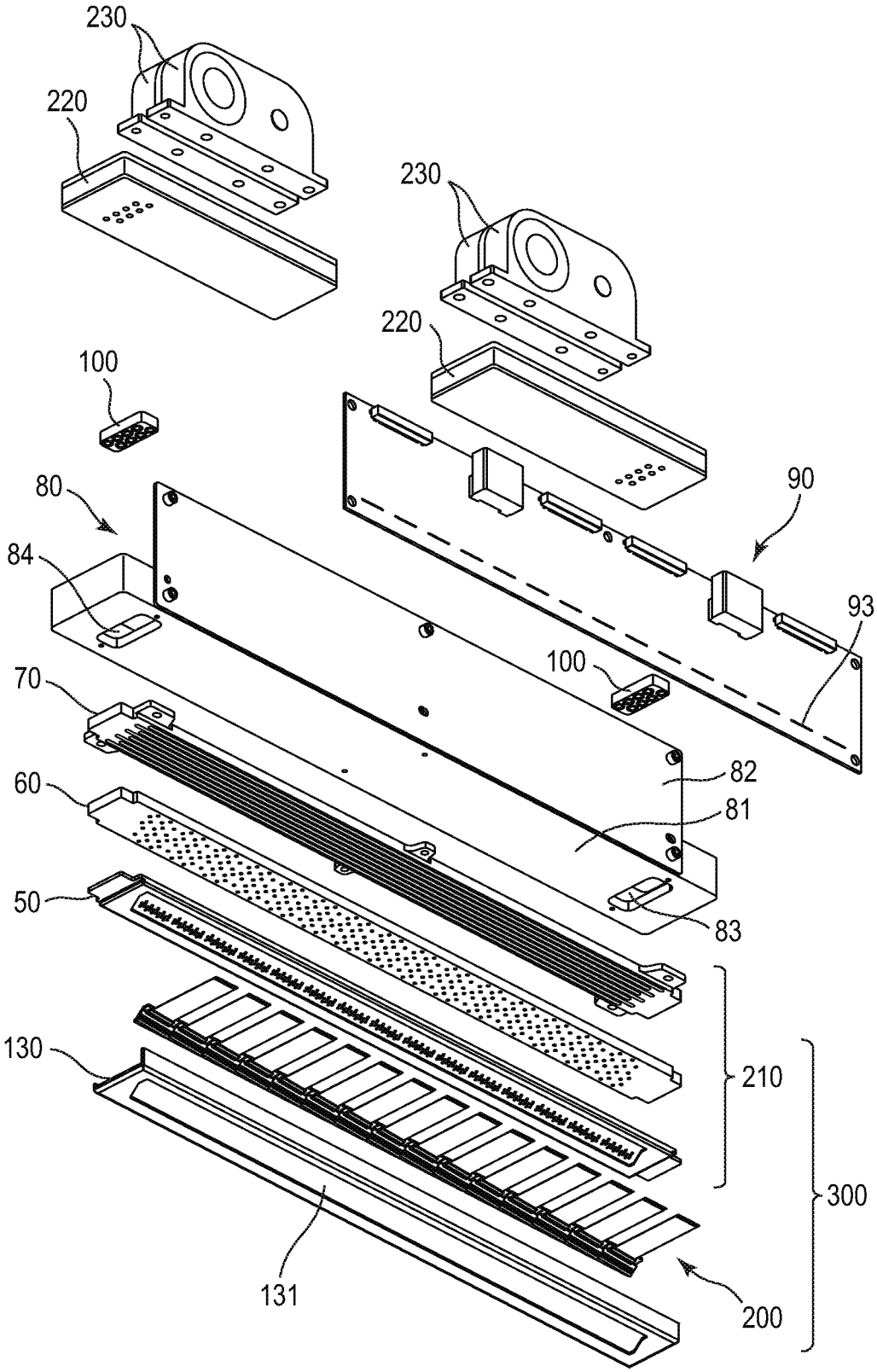
FIG. 5 is an exploded perspective view of the liquid ejection head illustrated in FIGS. 4A and 4B.

An exploded perspective view illustrating respective components or units that constitute the liquid ejection head 3 is illustrated in FIG. 5. The liquid ejection unit 300, the liquid supply unit 220, and the electrical wiring substrate 90 are attached to a housing 80. The liquid supply unit 220 is provided with the liquid connection unit 111 (refer to FIG. 3). A filter 221 (FIG. 2 and FIG. 3) for each color, which communicates with each opening of the liquid connection unit 111, is provided inside the liquid supply unit 220 in order to remove the foreign matter in the ink to be supplied. Each of the two liquid supply units 220 is provided with the color filters 221 equivalent to two colors. The liquid, which has passed through the filter 221, is supplied to the negative-pressure control unit 230 disposed on the liquid supply unit 220 in correspondence with each color. The negative-pressure control unit 230 is a unit including a pressure adjusting valve for each color. In this unit, a pressure loss change within the supply system (a supply system on the upstream side of the liquid ejection head 3) of the recording apparatus 1000 caused by the fluctuation of the flow rate of the liquid is markedly damped by the operation of a valve, a spring member, or the like provided inside each unit. Also, the unit is capable of stabilizing a negative-pressure change on the downstream side (liquid ejection unit 300 side) of the negative-pressure control unit to be within a certain range. As illustrated in FIG. 2, two pressure adjusting valves for each color are built within the negative-pressure control unit 230 for each color. The valves are set to have different control pressures, respectively, a high-pressure side thereof communicates with the common supply flow path 211 within the liquid ejection unit 300, and a low-pressure side thereof communicates with the common recovery flow path 212 via the liquid supply unit 220.

The housing 80 includes a liquid ejection unit support part 81 and an electrical wiring substrate support part 82, supports the liquid ejection unit 300 and the electrical wiring substrate 90, and secures the rigidity of the liquid ejection head 3. The electrical wiring substrate support part 82 is for supporting the electrical wiring substrate 90, and is fixed to the liquid ejection unit support part 81 by screw fastening. The liquid ejection unit support part 81 has a role of correcting the warpage or deformation of the liquid ejection unit 300, to secure the relative position accuracy of a plurality of recording element substrates 10, and thereby, suppresses streak or unevenness in a recorded material. For that reason, the liquid ejection unit support part 81 preferably has sufficient rigidity and as the material thereof, a metallic material, such as SUS or aluminum, or ceramic, such as alumina, is suitable. The liquid ejection unit support part 81 is provided with openings 83 and 84 into which joint rubbers 100 are inserted. The liquid supplied from the liquid supply unit 220 is guided to a third flow path member 70 that constitutes the liquid ejection unit 300 via the joint rubbers.

The liquid ejection unit 300 includes a plurality of ejection modules 200 and a flow path member 210, and a cover member 130 is attached to the surface of the liquid ejection unit 300 on the recording medium side. Here, the cover member 130 is a member having a frame-shaped front surface provided with an elongated opening 131 as illustrated in FIG. 5. Each recording element substrate 10 and a sealing part 110 (refer to FIGS. 9A and 9B) made of a sealing material, which are included in each ejection module 200, are exposed from the opening 131. A frame part around the opening 131 has a function as an abutting surface of a cap member that caps the liquid ejection head 3 in the recording standby mode. For this reason, it is preferred that an adhesive, a sealing material, a filler material, or the like is applied along the periphery of the opening 131 to fill irregularities or gaps on an ejection orifice surface of the liquid ejection unit 300 so that a closed space is formed at the time of the capping.

Next, the configuration of the flow path member 210 included in the liquid ejection unit 300 will be described. As illustrated in FIG. 5, the flow path member 210 is obtained by laminating a first flow path member 50, a second flow path member 60, and the third flow path member 70. Also, the flow path member 210 is a member for distributing the liquid, which is supplied from the liquid supply unit 220, to each ejection module 200, and returning the liquid, which is recirculated from the ejection module 200, to the liquid supply unit 220. The flow path member 210 is fixed to the liquid ejection unit support part 81 by screw fastening, and thereby, the warpage or deformation of the flow path member 210 is suppressed.

Figure 6A:
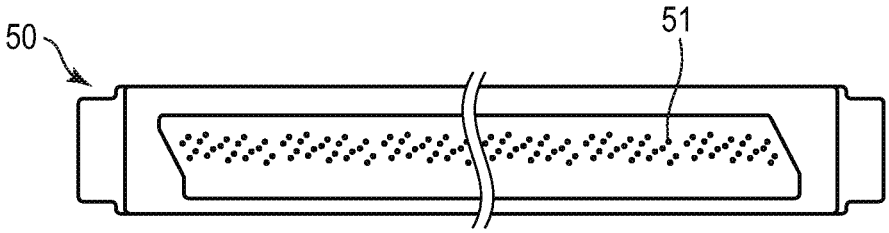
FIGS. 6A, 6B, 6C, 6D, 6E and 6F are plan views and bottom views of respective flow path members of the liquid ejection head illustrated in FIGS. 4A and 4B.
Figure 6B:
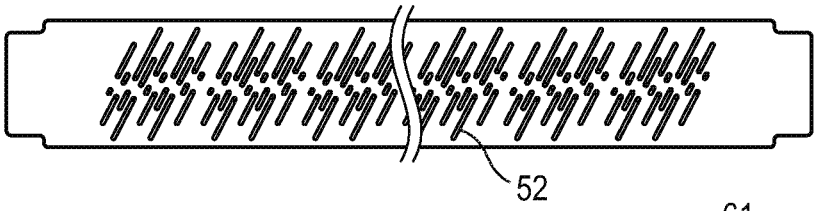
Figure 6C:
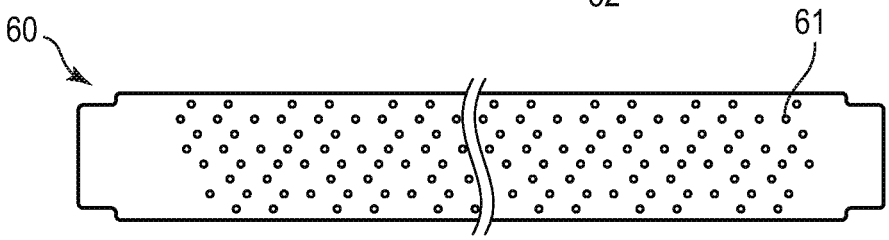
Figure 6D:
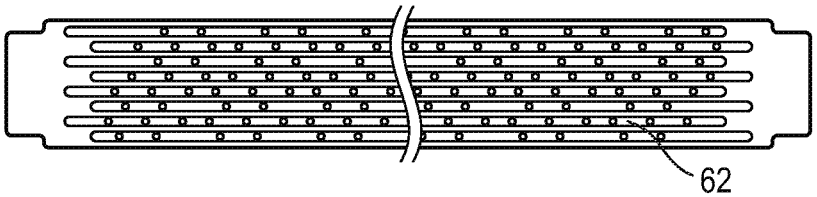
Figure 6E:
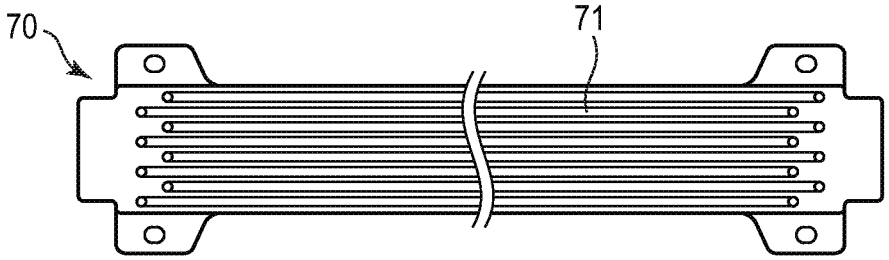
Figure 6F:
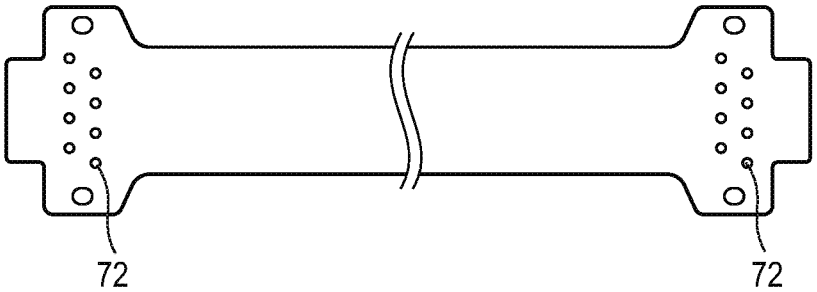
Figure 7:
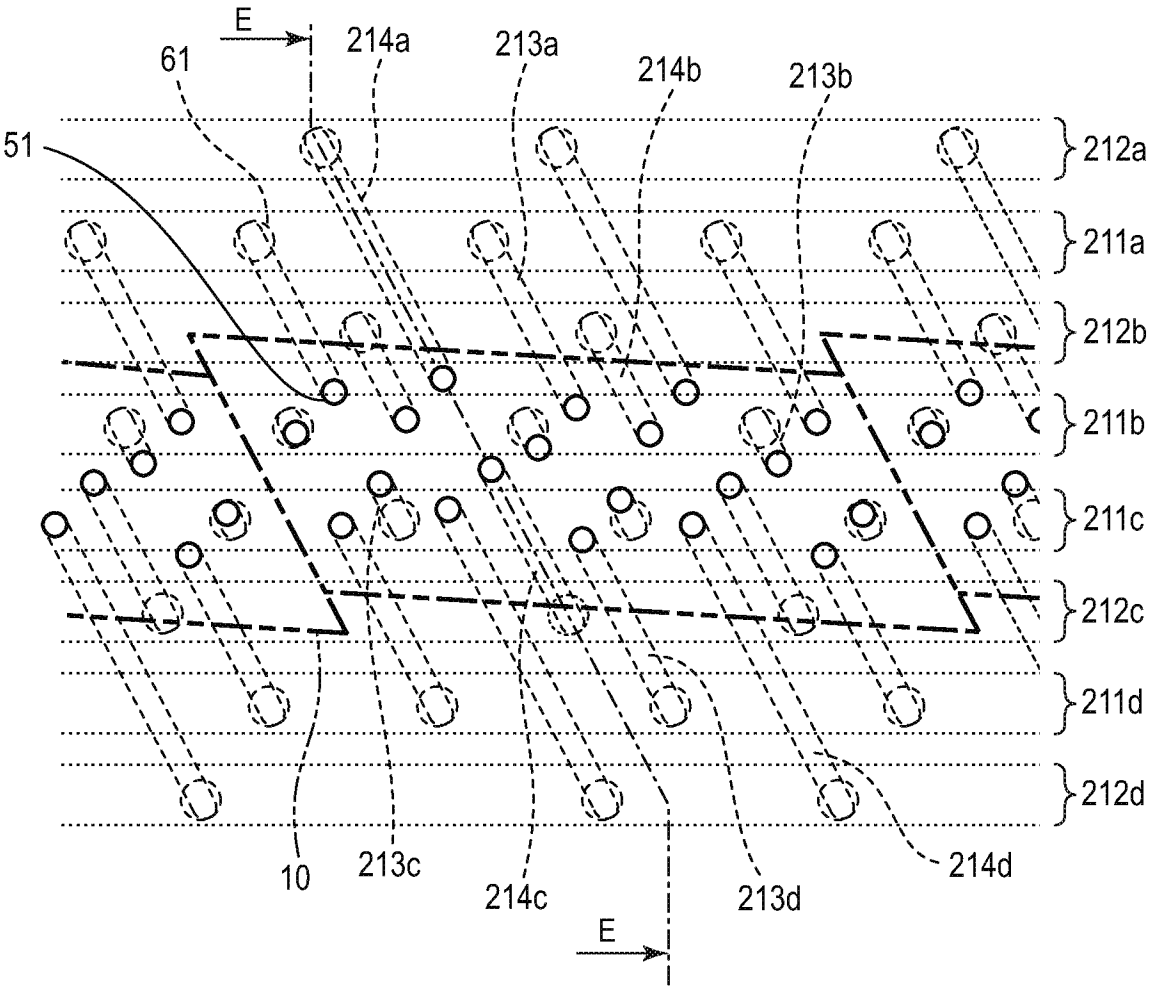
FIG. 7 is a perspective view of the flow path members illustrated in FIGS. 6A to 6F.

FIGS. 6A to 6F are views illustrating a front surface and a back surface of each flow path member of the first to third flow path members. FIG. 6A illustrates the surface of the first flow path member 50 on which the ejection modules 200 are mounted, and FIG. 6F illustrates the surface of the third flow path member 70 that abuts against the liquid ejection unit support part 81. The first flow path member 50 and the second flow path member 60 are joined to each other such that FIG. 6B and FIG. 6C, which are abutting surfaces of the respective flow path members, face each other, and the second flow path member and the third flow path member are joined to each other such that FIG. 6D and FIG. 6E, which are abutting surfaces of the respective flow path members, face each other. By joining the second flow path member 60 and the third flow path member 70 to each other, eight common flow paths, which extend in a longitudinal direction of each flow path member, are formed by common flow path grooves 62 and 71 formed in the respective flow path members. Accordingly, a set of the common supply flow path 211 and the common recovery flow path 212 is formed within the flow path member 210 for each color (FIG. 7). Communication ports 72 of the third flow path member 70 communicate with respective holes of the joint rubber 100, and fluidly communicate with the liquid supply unit 220. A plurality of the communication ports 61 is formed in bottom surfaces of the common flow path grooves 62 of the second flow path member 60, and communicates with the one-end parts of individual flow path grooves 52 of the first flow path member 50. Communication ports 51 are formed at other-end parts of the individual flow path grooves 52 of the first flow path member 50, and the other-end parts fluidly communicate with the plurality of ejection modules 200 via the communication ports 51, respectively. The individual flow path grooves 52 allow a flow path to be concentrated to a central side of a flow path member.

It is preferable that the first to third flow path members have corrosion resistance against the liquid and are made of a material with a low coefficient of linear expansion. The material includes, for example, alumina. In addition, the material can include a composite material (resin material) to which an inorganic filler, such as silica particulates or fibers, is added by using liquid crystal polymer (LCP), polyphenyl sulfide (PPS), polysulfone (PSF), or modified PPE (polyphenylene ether) as a base material. As a method of forming the flow path member 210, the three flow path members may be laminated and bonded to each other, or in a case where a composite resin material is selected as the material, a bonding method by welding may be used.

Next, the connection relationship of each flow path within the flow path member 210 will be described using FIG. 7. FIG. 7 is a perspective view illustrating, in an enlarged manner, a portion of a flow path in the flow path member 210 that is formed by joining the first to third flow path members to each other, from the side of the surface of the first flow path member 50 on which the ejection module 200 is mounted.

The common supply flow path 211 (211*a*, 211*b*, 211*c*, 211*d*) extended to the longitudinal direction of the liquid ejection head 3 for every color and the common recovery flow path (212*a*, 212*b*, 212*c*, 212*d*) are provided in the flow path member 210. A plurality of individual flow paths (213*a*, 213*b*, 213*c*, 213*d*) formed of the individual flow path grooves 52 is connected to the common supply flow path 211 for each color via the communication ports 61. Additionally, a plurality of individual recovery flow paths (214*a*, 214*b*, 214*c*, 214*d*) formed by the individual flow path grooves 52 is connected to the common recovery flow path 212 for each color via the communication ports 61. By virtue of such a flow path configuration, the ink can be concentrated on the recording element substrates 10 located at a central part of a flow path member via the individual flow paths 213 from each common supply flow paths 211. Additionally, the ink can be recovered from the recording element substrates 10 via the individual recovery flow paths 214 to each common recovery flow path 212.

Figure 8:
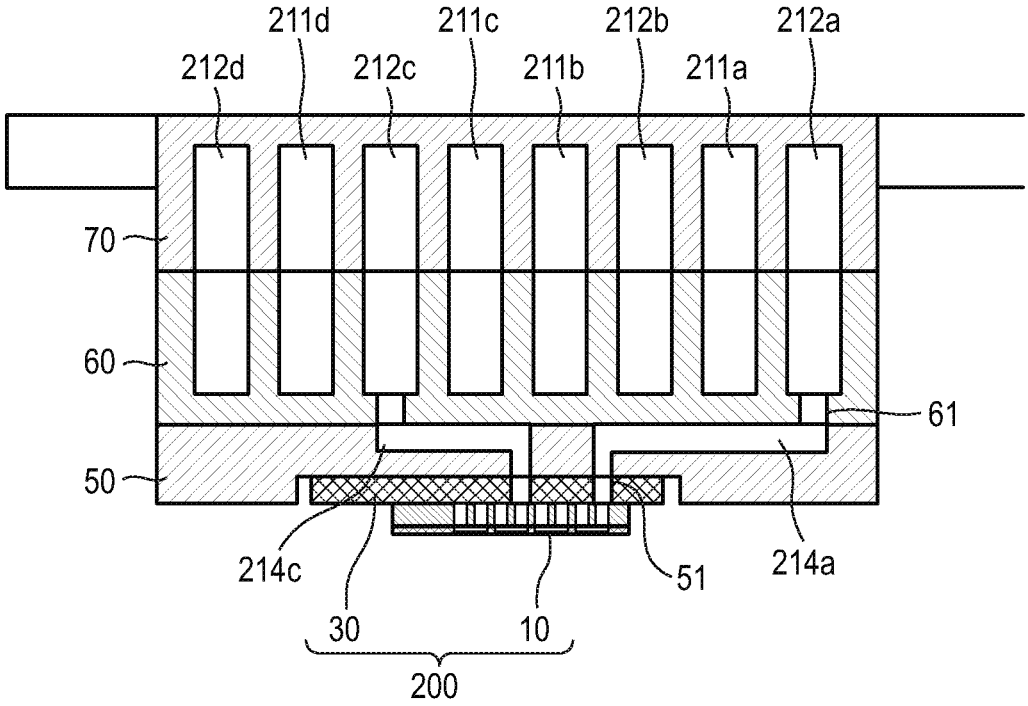
FIG. 8 is a sectional view of the liquid ejection head illustrated in FIGS. 4A and 4B.

FIG. 8 is a view illustrating a section taken along line E-E of FIG. 7. As illustrated in this drawing, the individual recovery flow paths (214*a*, 214*c*) communicate with the ejection module 200 via the communication ports 51. Although only the individual recovery flow paths (214*a*, 214*c*) are illustrated in FIG. 8, in another section, as illustrated in FIG. 7, the individual flow paths 213 and the ejection module 200 communicate with each other. Flow paths for supplying the ink from the first flow path member 50 to energy generating elements 14 (FIGS. 10A to 10C) provided in the recording element substrate 10 are formed in a support member 30 and the recording element substrate 10 that are included in each ejection module 200. Additionally, flow paths for recovering (recirculating) some or all of the liquid to be supplied to the energy generating elements 14 in the first flow path member 50 are formed. Here, the common supply flow path 211 for each color is connected to the negative-pressure control unit 230 (high-pressure side) for the corresponding color via the liquid supply unit 220, and the common recovery flow path 212 is connected to the negative-pressure control unit 230 (low-pressure side) via the liquid supply unit 220. A differential pressure (pressure difference) is caused between the common supply flow path 211 and the common recovery flow path 212 by the negative-pressure control unit 230. For this reason, within the liquid ejection head of the present embodiment in which the respective flow paths are connected to each other as illustrated in FIGS. 7 and 8, an ink flow which flows into the common supply flow path 211—the individual supply flow path 213*a*—the recording element substrate 10—the individual recovery flow path 213*b*—the common recovery flow path 212 in order for each color is generated.

(Description of Ejection Module)

Figure 9A:
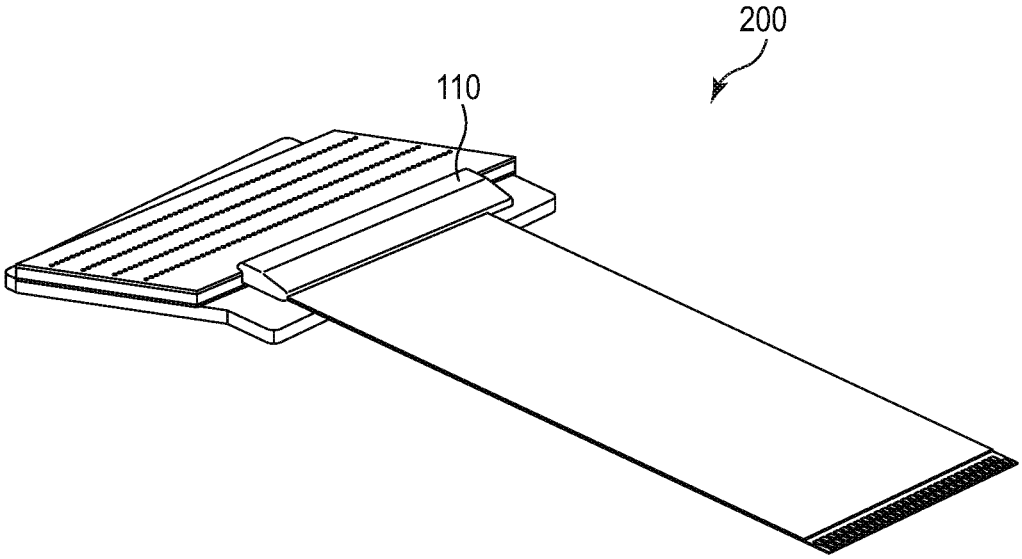
FIGS. 9A and 9B are a perspective view and an exploded perspective view of an ejection module of the liquid ejection head illustrated in FIGS. 4A and 4B.
Figure 9B:
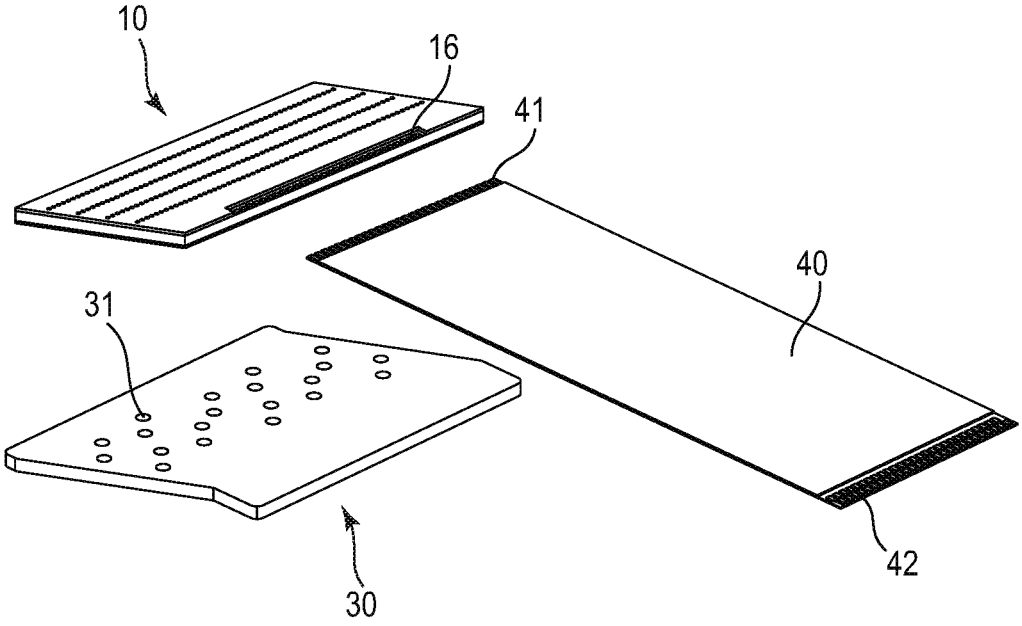

FIG. 9A is a perspective view illustrating one ejection module 200, and FIG. 9B is an exploded view of the ejection module 200. As a method of manufacturing the ejection module 200, first, the recording element substrate 10 and the flexible wiring substrate 40 are bonded onto the support member 30 provided with liquid communication ports 31 in advance. Then, terminals 16 on the recording element substrate 10 and terminals 41 on the flexible wiring substrate 40 are electrically connected to each other by wire bonding, and thereafter, wire-bonded parts (electrical connection parts) are covered and sealed with a sealing part 110. Terminals 42 of the flexible wiring substrate 40 opposite the recording element substrate 10 are electrically connected to connection terminals 93 (refer to FIG. 5) of the electrical wiring substrate 90. Since the support member 30 is a support body that supports the recording element substrate 10, and is a flow path member that allows the recording element substrate 10 and the flow path member 210 to fluidly communicate with each other, a support member, which has high flatness and can be joined to the recording element substrate with sufficiently high reliability, is preferably used. Alumina or a resin material is a preferable example of the material.

(Description of Structure of Recording Element Substrate)

Figure 10A:
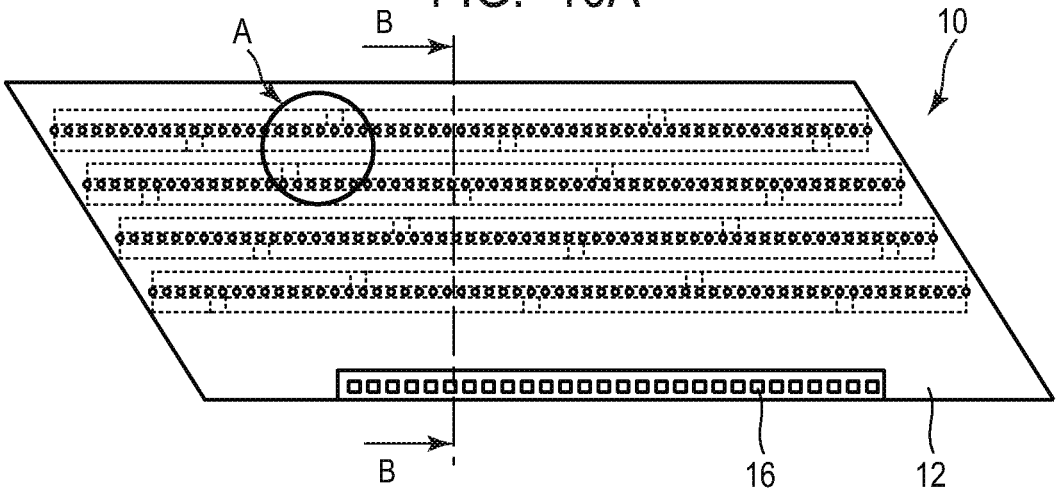
FIGS. 10A, 10B and 10C are a plan view, an enlarged plan view, and a back view of a recording element substrate of the liquid ejection head illustrated in FIGS. 4A and 4B.
Figure 10B:
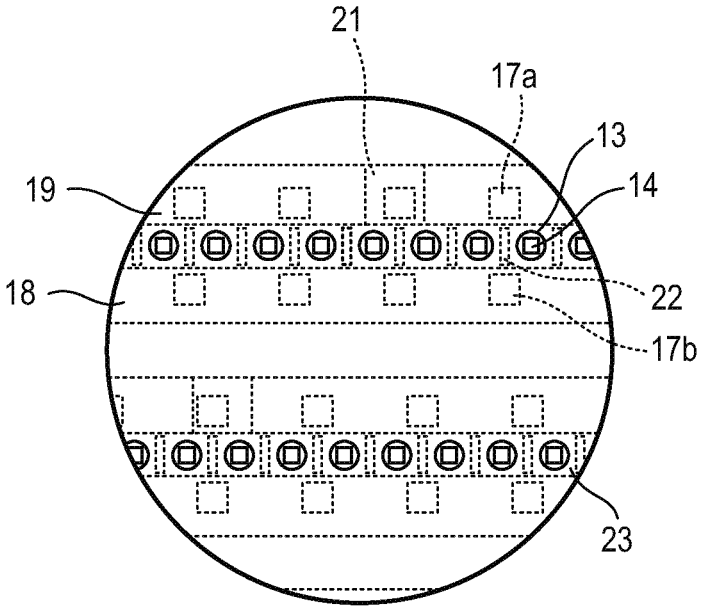
Figure 10C:
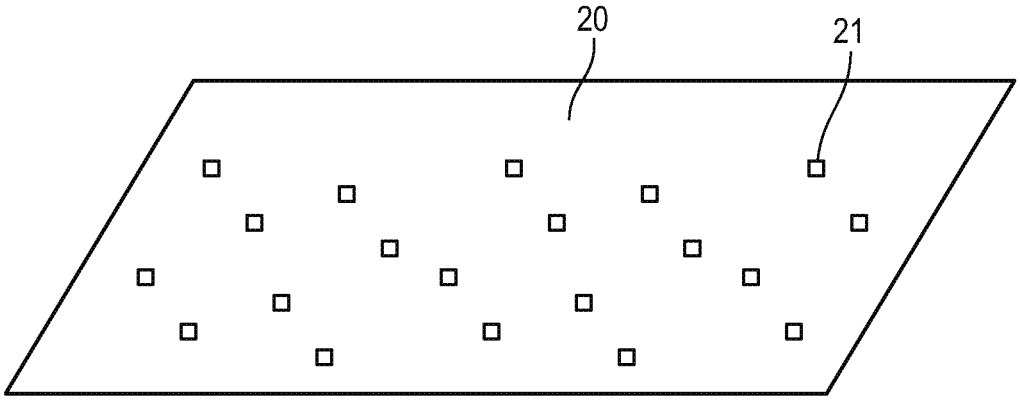

Here, the configuration of the recording element substrate 10 will be described. FIG. 10A illustrates a plan view of a surface of the recording element substrate 10 in which ejection orifices 9 are formed, FIG. 10B illustrates an enlarged view of a portion indicated by A of FIG. 10A, and FIG. 10C illustrates a plan view of a back surface of FIG. 10A. As illustrated in FIG. 10A, four ejection orifice lines corresponding to the respective ink colors are formed in an ejection orifice forming member 12 of the recording element substrate 10. In addition, hereinafter, a direction in which the ejection orifice line in which a plurality of ejection orifices 9 is arranged extends is referred to as a "ejection orifice line direction".

As illustrated in FIG. 10B, the energy generating element 14 that is a heat generating element for bubbling the liquid with heat energy is disposed at a position corresponding to each ejection orifice 9. The pressure chamber 23 including the energy generating element 14 therein is partitioned by a partition wall 22. The energy generating element 14 is electrically connected to a terminal 16 of FIG. 10A by electrical wiring (not illustrated) provided in the recording element substrate 10. Also, the energy generating element 45 generates heat on the basis of a pulse signal input via the electrical wiring substrate 90 (refer to FIG. 5) and the flexible wiring substrate 40 (refer to FIGS. 9A and 9B) from a control circuit of the recording apparatus 1000, and boils the liquid. The liquid is ejected from the ejection orifice 9 by a bubbling force resulting from this boiling. As illustrated in FIG. 10B, a supply flow path 18 extends on one side along each ejection orifice line, and a recovery flow path 19 extends on the other side along each ejection orifice line. The supply flow path 18 and the recovery flow path 19 are flow paths that extend in the ejection orifice line direction provided in the recording element substrate 10, and communicate with the ejection orifices 9 via supply ports 17*a* and recovery ports 17*b*, respectively.

Figure 11:
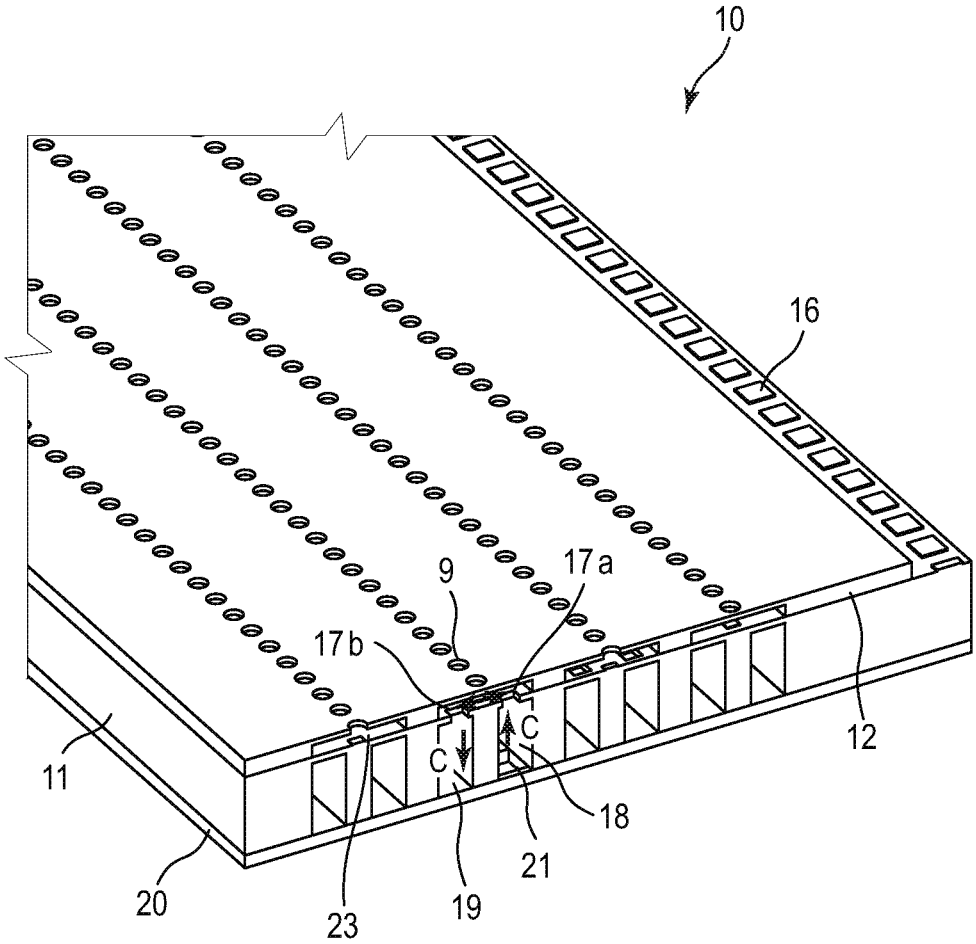
FIG. 11 is a partial cutaway perspective view of the liquid ejection head illustrated in FIGS. 4A and 4B.

As illustrated in FIG. 10C and FIG. 11, a sheet-like lid member 20 is laminated on a back surface of the surface of the recording element substrate 10 in which the ejection orifices 9 are formed, and the lid member 20 is provided with a plurality of openings 21 that communicates with the supply flow path 18 and the recovery flow path 19 to be described below. In the present embodiment, the lid member 20 is provided with three openings 21 with respect to one supply flow path 18 and two openings 21 with respect to one recovery flow path 19. As illustrated in FIG. 10B, each opening 21 of the lid member 20 communicates with a plurality of communication ports 51 illustrated in FIG. 6A. As illustrated in FIG. 11, the lid member 20 has a function as a lid that forms portions of walls of the supply flow paths 18 and the recovery flow paths 19 that are formed in a substrate 11 of the recording element substrate 10. The lid member 20 preferably has sufficient corrosion resistance against the liquid. Additionally, from a viewpoint of preventing color mixing, high accuracy is required for the opening shape and the opening position of the openings 21. For this reason, it is preferable that a photosensitive resin material or a silicon plate is used as the material of the lid member 20, and the openings 21 are provided by a photolithographic process. In this way, the lid member 20 converts the pitch of the flow paths depending on the openings 21, preferably has a smaller thickness if pressure loss is taken into consideration, and is preferably made of a film-like member.

Next, the flow of the liquid within the recording element substrate 10 will be described. FIG. 11 is a perspective view illustrating a section of the recording element substrate 10 and the lid member 20 taken along B-B in FIG. 10A. In the recording element substrate 10, the substrate 11 formed of Si and the ejection orifice forming member 12 formed of photosensitive resin are laminated on each other, and the lid member 20 is joined to a back surface of the substrate 11. The energy generating elements 14 are formed on one surface side of the substrate 11 (refer to FIGS. 10A to 10C), and grooves, which constitute the supply flow paths 18 and the recovery flow paths 19 that extend along the ejection orifice lines, are formed on a back surface side of the substrate 11. The supply flow paths 18 and the recovery flow paths 19, that are formed by the substrate 11 and the lid member 20, are respectively connected to the common supply flow paths 211 and the common recovery flow paths 212 within the flow path member 210, and a pressure difference is caused between each supply flow path 18 and each recovery flow path 19. An ejection orifice that does not perform an ejection operation when the liquid is ejected from the plurality of ejection orifices 9 of the liquid ejection head 3 to perform recording will be described. In this ejection orifice, due to the above-described pressure difference, the liquid within the supply flow path 18 provided within the substrate 11 flows to the recovery flow path 19 via the supply port 17*a*, the pressure chamber 23, and the recovery port 17*b* (a flow indicated by the arrow C of FIGS. 10A to 10C). Due to this flow, in an ejection orifice 9 and a pressure chamber 23 in which the recording is paused, viscosity-increased ink, bubbles, foreign matter, and the like, which are caused by evaporation from the ejection orifice 9, can be recovered to the recovery flow path 19. Additionally, the increase in viscosity of the ink of the ejection orifice 9 or the pressure chamber 23 can be suppressed. The liquid recovered to the recovery flow path 19 is recovered in order of the communication port 51, the individual recovery flow path 214, and the common recovery flow path 212 within the flow path member 210 through the opening 21 of the lid member 20 and the liquid communication port 31 (refer to FIG. 9B) of the support member 30. Then, the liquid is finally recovered to the supply path of the recording apparatus 1000.

That is, the liquid supplied from the recording apparatus body to the liquid ejection head 3 flows, is supplied, and is recovered in the following order. First, the liquid is supplied from the liquid connection unit 111 of the liquid supply unit 220 to the inside of the liquid ejection head 3. Then, the liquid is supplied in order of the joint rubber 100, the communication port 72 and the common flow path groove 71 that are provided in the third flow path member, the common flow path groove 62 and the communication port 61 that are provided in the second flow path member, and the individual flow path groove 52 and the communication port 51 that are provided in the first flow path member. Thereafter, the liquid is supplied to the pressure chamber 23 via the liquid communication port 31 provided in the support member 30, the opening 21 provided in the lid member, and the supply flow path 18 and the supply port 17*a* that are provided in the substrate 11 in order. The liquid, which is not ejected from the ejection orifice 9 in the liquid supplied to the pressure chamber 23, flows through the recovery port 17*b* and the recovery flow path 19 that are provided in the substrate 11, the opening 21 provided in the lid member, and the liquid communication port 31 provided in the support member 30 in order. Thereafter, the liquid flows through the communication port 51 and the individual flow path groove 52 that are provided in the first flow path member, the communication port 61 and the common flow path groove 62 that are provided in the second flow path member, the common flow path groove 71 and the communication port 72 that are provided in the third flow path member 70, and the joint rubber 100 in order. Then, the liquid flows from the liquid connection unit 111 provided in the liquid supply unit to the outside of the liquid ejection head 3. In the form of the first circulation path illustrated in FIG. 2, the liquid, which is supplied from the liquid connection unit 111, is supplied to the joint rubber 100 after passing through the negative-pressure control unit 230, and is as follows in the second circulation path illustrated in FIG. 3. That is, the liquid recovered from the pressure chamber 23 passes through the joint rubber 100, and then flows from the liquid connection unit 111 via the negative-pressure control unit 230 to the outside of the liquid ejection head.

Additionally, as illustrated in FIG. 2 and FIG. 3, the whole liquid, which has flowed in from one end of the common supply flow path 211 of the liquid ejection unit 300, is not necessarily supplied to the pressure chamber 23 via the individual supply flow path 213*a*. There is also a liquid that flows from the other end of the common supply flow path 211 to the liquid supply unit 220 without being supplied to the individual supply flow path 213*a*. In this way, a path along which the liquid flows without passing through the recording element substrate 10 is included. By doing this, a back flow of a circulatory flow of the liquid can be suppressed even in a case where the recording element substrate 10 including a flow path that is thin and is relatively large in flow resistance as in the present embodiment is included. In this way, in the liquid ejection head of the present embodiment, the increase in viscosity of the liquid in the pressure chamber or a part near the ejection orifice can be suppressed. Thus, an ejection error or non-ejection can be suppressed, and consequently, high-quality recording can be performed.

(Description of Positional Relationship Between Recording Element Substrates)

Figure 12:
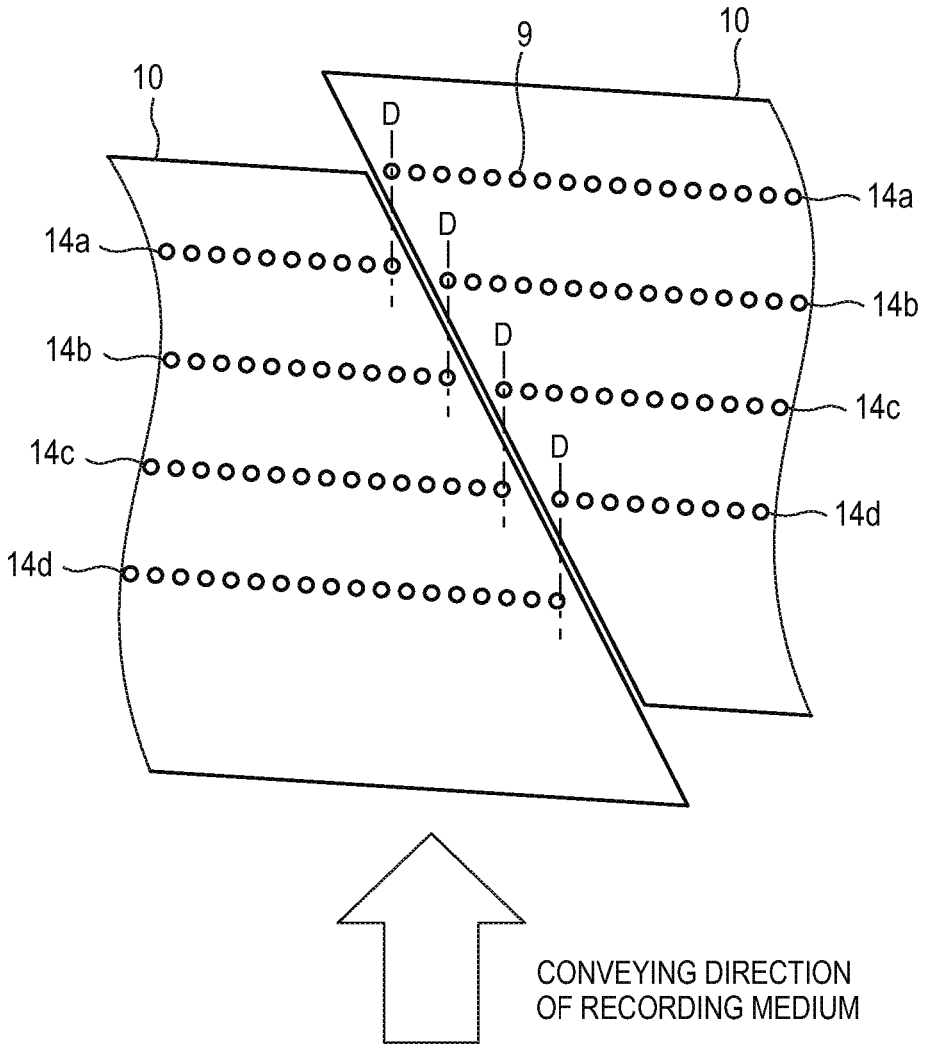
FIG. 12 is an enlarged plan view of main parts illustrating two adjacent recording element substrates of the liquid ejection head illustrated in FIGS. 4A and 4B.

FIG. 12 is a partially enlarged plan view illustrating adjacent parts of recording element substrates in two adjacent ejection modules. As illustrated in FIGS. 10A to 10C, in the present embodiment, recording element substrates having a substantially parallelogram shape are used. As illustrated in FIG. 12, the respective ejection orifice lines (14*a* to 14*d*) of each recording element substrate 10 in which the ejection orifices 9 are arranged are disposed so as to be tilted at a certain angle with respect to the conveying direction of the recording medium. Accordingly, on ejection lines in the adjacent parts between the recording element substrates 10, at least one ejection orifice is overlapped in the conveying direction of the recording medium. In FIG. 12, there is a relationship in which two ejection orifices on a line D overlap each other. By virtue of such a configuration, even in a case where the position of the recording element substrate 10 slightly shifts from a predetermined position, black striping or white spotting of a recording image can be made inconspicuous by the drive control of the ejection orifices that overlap each other. Even in a case where the plurality of recording element substrates 10 is disposed on a straight line (in-line) instead of a zigzag arrangement, by virtue of the configuration as illustrated in FIG. 12, an increase in the length of the recording element substrate 10 in the conveying direction of the recording medium of the liquid ejection head 3 can be suppressed. Moreover, countermeasures against the black striping or white spotting in connected parts between the recording element substrates 10 can be performed. In addition, in the present embodiment, the principal plane of the recording element substrates has a parallelogram shape. However, the present disclosure is not limited to this. For example, even in a case where recording element substrates having an oblong shape, a trapezoidal shape, or other shapes are used, the configuration of the present disclosure can be preferably applied.

Other Application Examples

The configurations of the ink jet recording apparatus 1000 and the liquid ejection head 3 of another application example (referred to as a second application example) of the present disclosure will be described. In addition, in the following description, only portions different from the above example (referred to as a first application example) will mainly be described, and description of substantially the same portions as those of the first application example will be omitted.

(Description of Ink Jet Recording Apparatus)

In the ink jet recording apparatus according to the second application example of the present disclosure, similarly to the first application example, the supply system, the buffer tank 1003, and the main tank 1006 (refer to FIG. 2) of the recording apparatus 1000 are fluidly connected to each liquid ejection head 3. Additionally, an electrical control unit, which transmits electrical power and an ejection control signal to the liquid ejection head 3, is electrically connected to each liquid ejection head 3.

(Description of Circulation Path)

Similarly to the first application example, as a liquid circulation path between the recording apparatus 1000 and the liquid ejection head 3, the first and second circulation paths illustrated in FIG. 2 or 3 can be used.

(Description of Structure of Liquid Ejection Head)

Figure 13A:
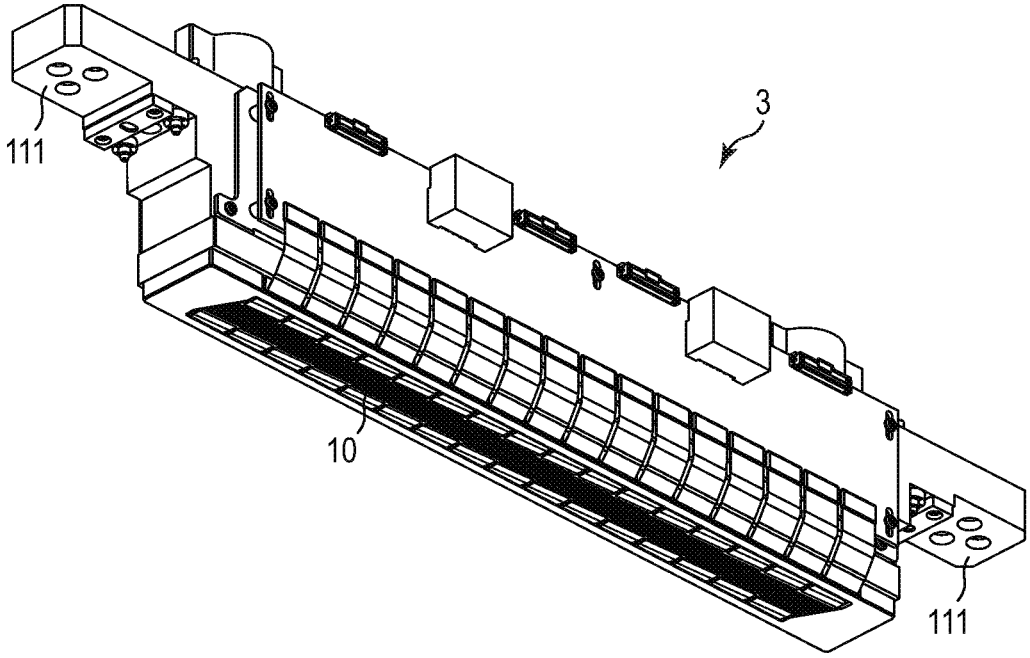
FIGS. 13A and 13B are perspective views of a liquid ejection head.
Figure 13B:
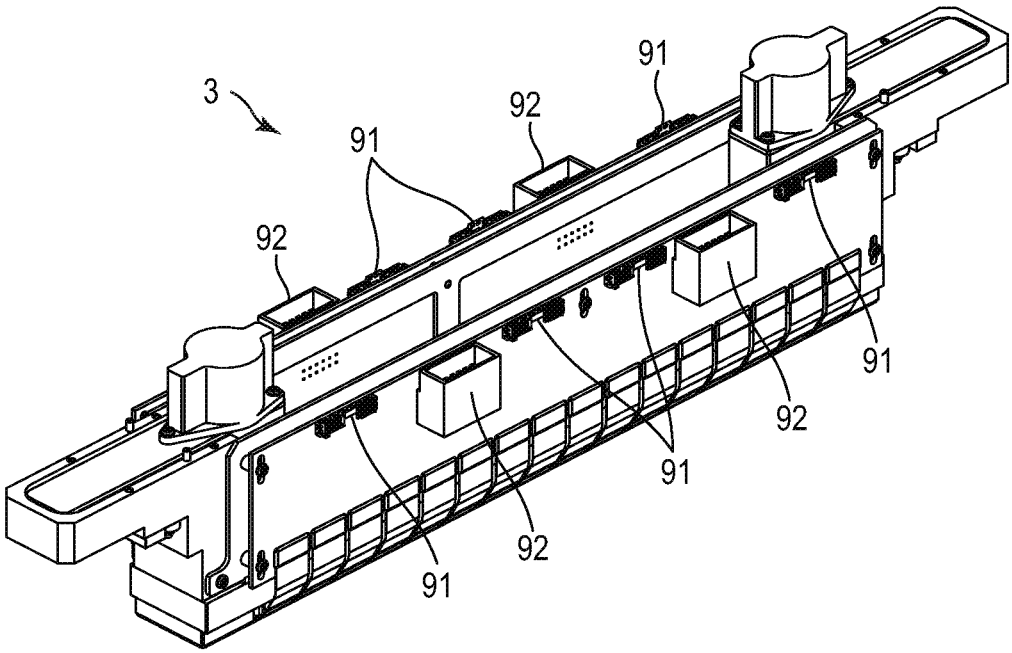

The structure of the liquid ejection head 3 related to the second application example of the present disclosure will be described. FIGS. 13A and 13B are perspective views of the liquid ejection head 3 related to the present application example. The liquid ejection head 3 is an ink jet line-type recording head that includes sixteen recording element substrates 10 that are linearly arranged in a longitudinal direction of the liquid ejection head 3. The liquid ejection head 3 includes the liquid connection unit 111, the signal input terminals 91, and the electrical power supply terminals 92 similarly to the first application example. However, since the liquid ejection head 3 of the present application example has more ejection orifice lines than that of the first application example, the signal output terminals 91 and the electrical power supply terminals 92 are disposed on both sides of the liquid ejection head 3. This is because voltage drop or signal transmission delay, which is caused in wiring parts provided in the recording element substrates 10, is reduced.

Figure 14:
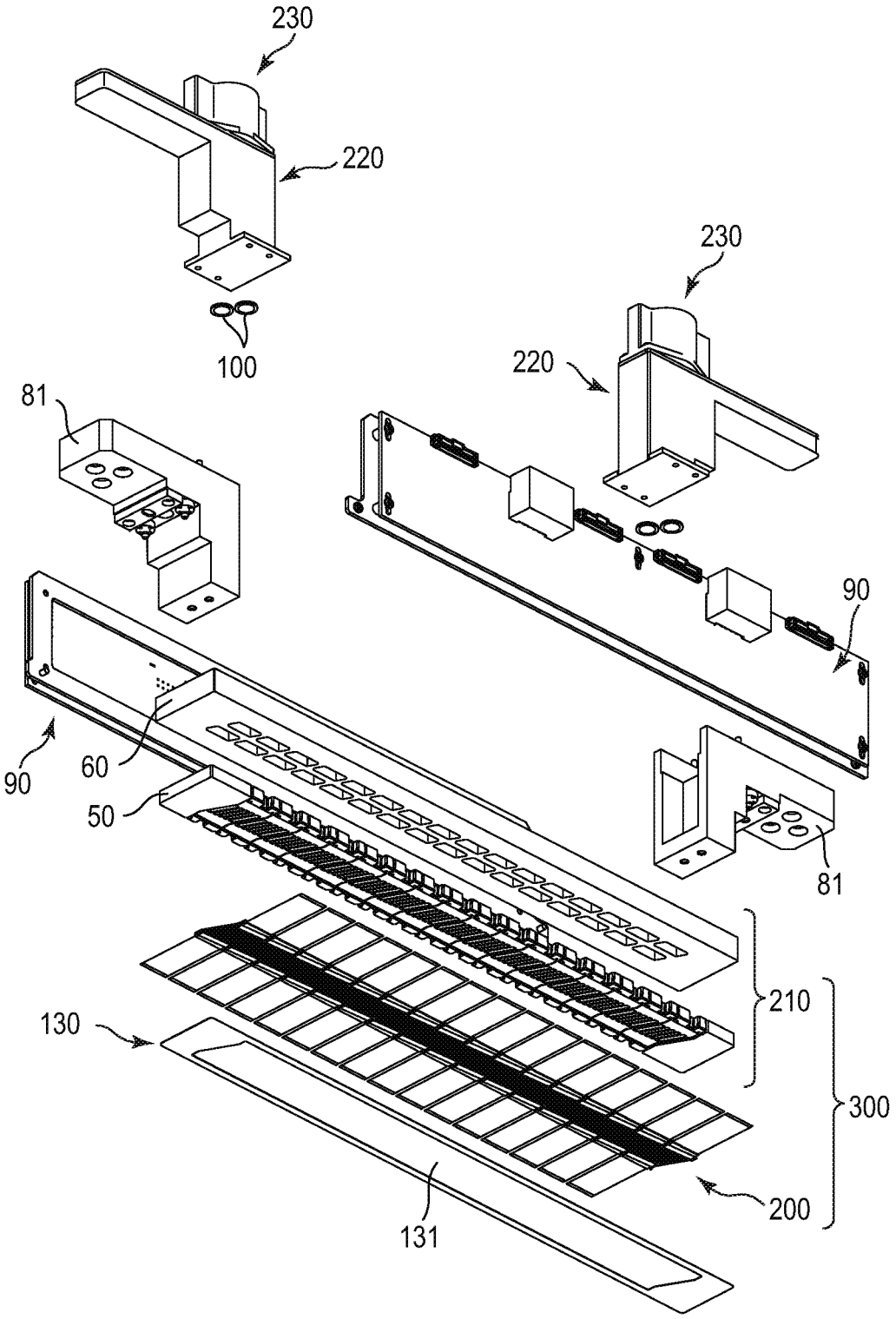
FIG. 14 is an exploded perspective view of the liquid ejection head illustrated in FIGS. 13A and 13B.

FIG. 14 is an exploded perspective view illustrating the liquid ejection head 3, and illustrates respective components or units that constitute the liquid ejection head 3 separately for each function. Although the roles of the respective units and members and the order of liquid circulation within the liquid ejection head are basically the same as those of the first application example, the functions of guaranteeing the rigidity of the liquid ejection head are different. In the first application example, the rigidity of the liquid ejection head is mainly guaranteed by the liquid ejection unit support part 81. However, in the liquid ejection head of the second application example, the rigidity of the liquid ejection head is guaranteed by the second flow path member 60 included in the liquid ejection unit 300. The liquid ejection unit support part 81 in the present application example is connected to both end parts of the second flow path member 60, and the liquid ejection unit 300 is mechanically combined with a carriage of the recording apparatus 1000 to perform positioning of the liquid ejection head 3. The liquid supply unit 220 including the negative-pressure control unit 230, and the electrical wiring substrate 90 are combined with the liquid ejection unit support part 81. Filters (not illustrated) are respectively built within two liquid supply units 220. The two negative-pressure control units 230 set different pressures, respectively, and are respectively a negative-pressure control unit 230 that produces a negative pressure but a relatively high pressure, and a negative-pressure control unit 230 that produces a negative pressure and relatively low pressure. As illustrated in this drawing, in a case where the negative-pressure control units 230 on the high-pressure side and the low-pressure side are respectively installed at both end parts of the liquid ejection head 3, the flows of the liquid in the common supply flow path 211 and the common recovery flow path 212 that extend in the longitudinal direction of the liquid ejection head 3 faces each other. By doing this, heat exchange is promoted between the common supply flow path 211 and the common recovery flow path 212, and a temperature difference within the two common flow paths is reduced. Thus, a temperature difference in the plurality of respective recording element substrates 10 provided along the common flow paths is insignificant. As a result, there are advantages that recording unevenness resulting from the temperature difference does not occur easily.

Next, details of the flow path member 210 of the liquid ejection unit 300 will be described. As illustrated in FIG. 14, the flow path member 210 is obtained by laminating the first flow path member 50 and the second flow path member 60, and distributes the liquid, which is supplied from the liquid supply unit 220, to the respective ejection modules 200. Additionally, the flow path member 210 functions as a flow path member for returning the liquid, which is recirculated from the ejection modules 200, to the liquid supply unit 220. The second flow path member 60 of the flow path member 210 is a flow path member that has the common supply flow path 211 and the common recovery flow path 212 formed therein, and has a function of mainly bearing the rigidity of the liquid ejection head 3. For this reason, the material of the second flow path member 60 preferably has sufficient corrosion resistance against the liquid and high machine strength. Specifically, stainless steel, Ti, alumina, or the like can be preferably used.

Figure 15A:
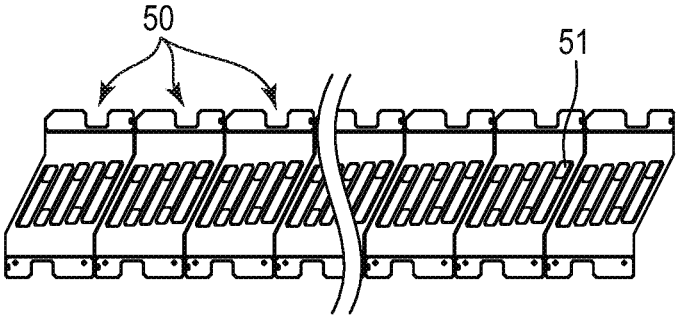
FIGS. 15A, 15B, 15C, 15D and 15E are plan views and bottom views of respective flow path members of the liquid ejection head illustrated in FIGS. 13A and 13B.
Figure 15B:
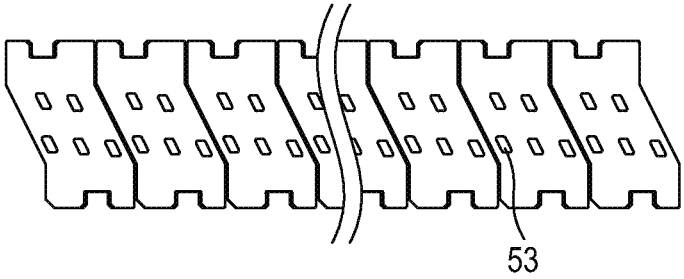
Figure 15C:
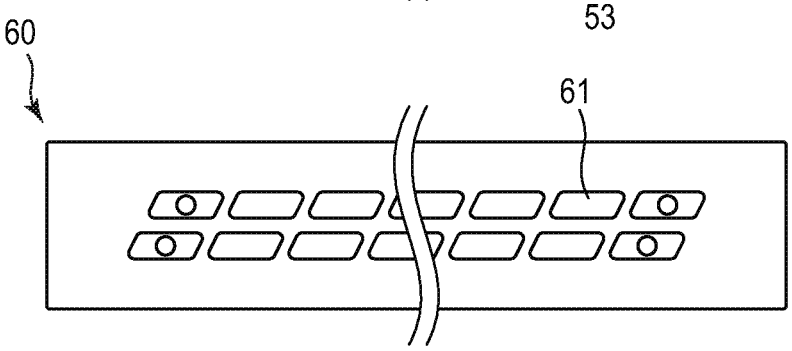
Figure 15D:
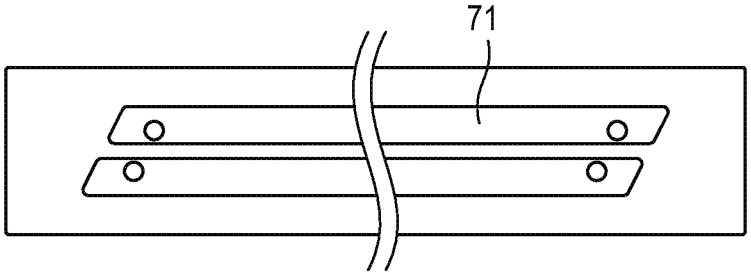
Figure 15E:
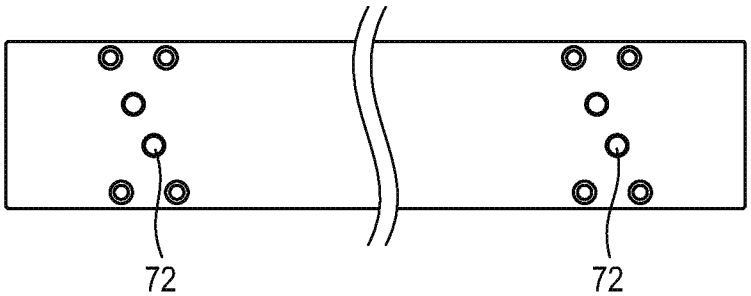

FIG. 15A is a view illustrating the surface of the first flow path member 50 on which the ejection modules 200 are mounted, and FIG. 15B is a view illustrating a back surface of the first flow path member that abuts against the second flow path member 60. Unlike the first application example, first flow path members 50 in the present application example are obtained by adjacently arranging a plurality of members that correspond to the ejection modules 200, respectively. By taking the structure divided in this way, the plurality of modules can be arranged so as to correspond to the length of the liquid ejection head. Thus, for example, the present disclosure can be particularly preferably applied to a liquid ejection head of comparatively long scales corresponding to B2 size and a length equal to or larger than the B2 size. As illustrated in FIG. 15A, the communication ports 51 of the first flow path members 50 fluidly communicate with the ejection modules 200, and as illustrated in FIG. 15B, the individual communication ports 53 of the first flow path members 50 fluidly communicate with the communication ports 61 of the second flow path member 60. FIG. 15C illustrates the surface of the second flow path member 60 that abuts the first flow path members 50, FIG. 15D illustrates a section of a thickness-direction central part of the second flow path member 60, and FIG. 15E is a view illustrating the surface of the second flow path member 60 that abuts against the liquid supply unit 220. The functions of the flow paths or communication ports of the second flow path member 60 are the same as those for one color, of the first application example. One of the common flow path grooves 71 of the second flow path member 60 is the common supply flow path 211 illustrated in FIG. 16, the other thereof is the common recovery flow path 212, and both the common flow path grooves are respectively provided in the longitudinal direction of the liquid ejection head 3 and allow the liquid to be supplied from the one end side to the other end side. In the present application example, unlike the first application example, the flow directions of the liquid in the common supply flow path 211 and the common recovery flow path 212 are mutually opposite directions.

Figure 16:
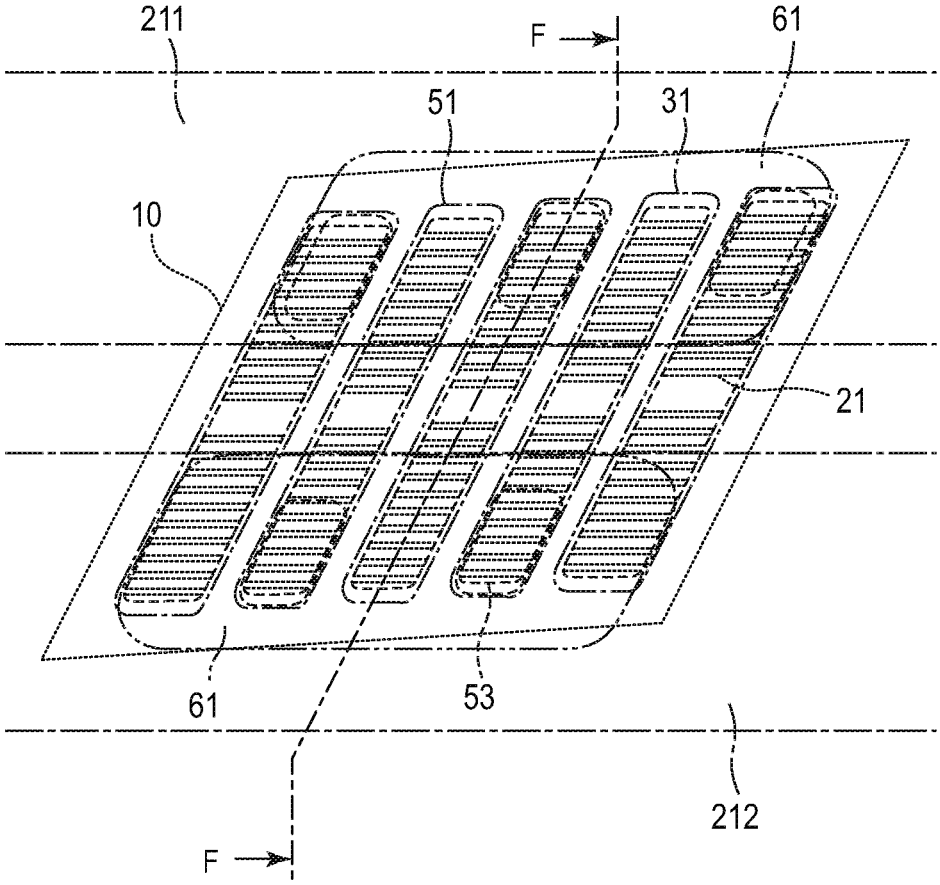
FIG. 16 is a view illustrating a connected state between a recording element substrate and flow paths of the flow path members of the liquid ejection head illustrated in FIGS. 13A and 13B.

FIG. 16 is a perspective view illustrating a liquid connection relationship between the recording element substrate 10 and the flow path member 210. As illustrated in FIG. 16, a set of the common supply flow path 211 and the common recovery flow path 212 that extend in the longitudinal direction of the liquid ejection head 3 is provided within the flow path member 210. The communication ports 61 of the second flow path member 60 are aligned with and connected to the individual communication ports 53 of the respective first flow path members 50, and liquid supply paths that allow communication from the communication ports 72 of the second flow path member 60 via the common supply flow path 211 to the communication ports 51 of the first flow path members 50 are formed. Similarly, liquid supply paths that allow communication from the communication ports 72 of the second flow path member 60 via the common recovery flow path 212 to the communication ports 51 of the first flow path members 50 are also formed.

Figure 17:
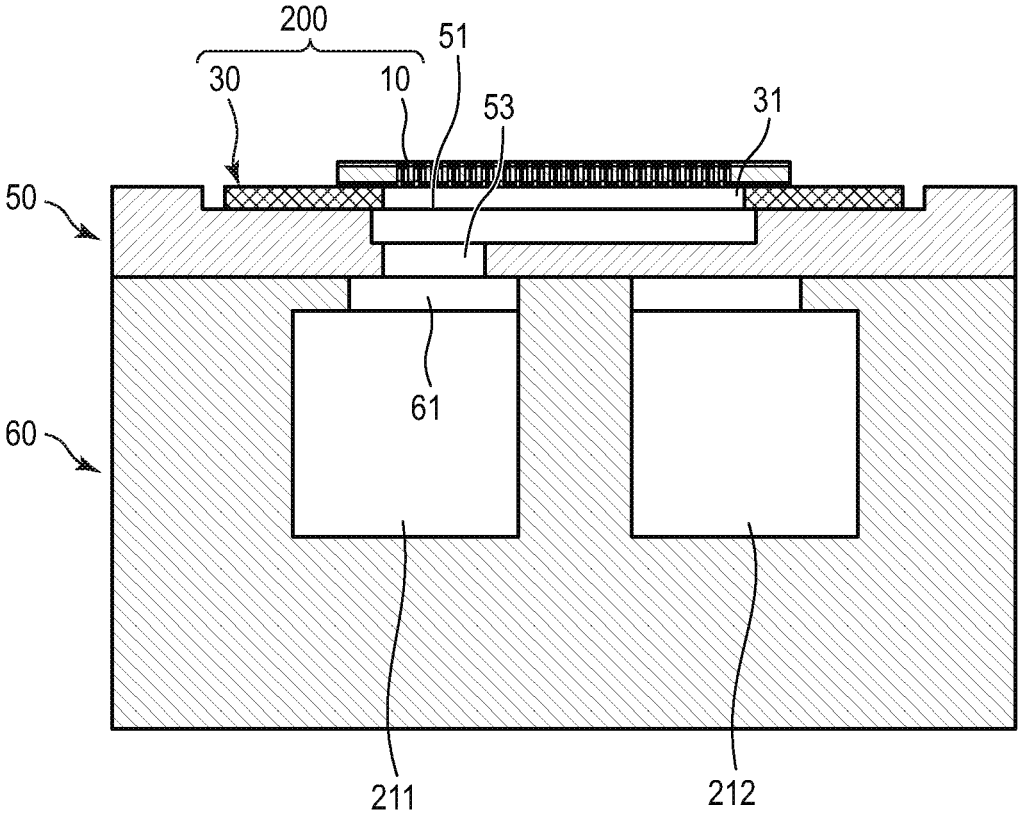
FIG. 17 is a sectional view of the liquid ejection head taken along line F-F of FIG. 16.

FIG. 17 is a view illustrating a section taken along line F-F of FIG. 16. As illustrated in this drawing, the common supply flow path is connected to the ejection module 200 via the communication port 61, the individual communication port 53, and the communication port 51. Although not illustrated in FIG. 8, in another section, it is clear from FIG. 16 that the individual recovery flow path is connected to the ejection module 200 with the same path. Similarly to the first application example, in each ejection module 200 and each recording element substrate 10, flow paths that communicate with the respective ejection orifices 9 are formed, some or all of the supplied liquid can pass through an ejection orifice 9 (pressure chamber 23) that pauses an ejection operation, and be recirculated. Additionally, similarly to the first application example, the common supply flow path 211 is connected to the negative-pressure control unit 230 (high-pressure side) via the liquid supply unit 220, and the common recovery flow path 212 is connected to the negative-pressure control unit 230 (low-pressure side) via the liquid supply unit 220. Therefore, due to a pressure difference therebetween, a flow, which passes through the ejection orifice 9 (pressure chamber 23) of the recording element substrate 10 from the common supply flow path 211 and reaches the common recovery flow path 212, is generated.

(Description of Ejection Module)

Figure 18A:
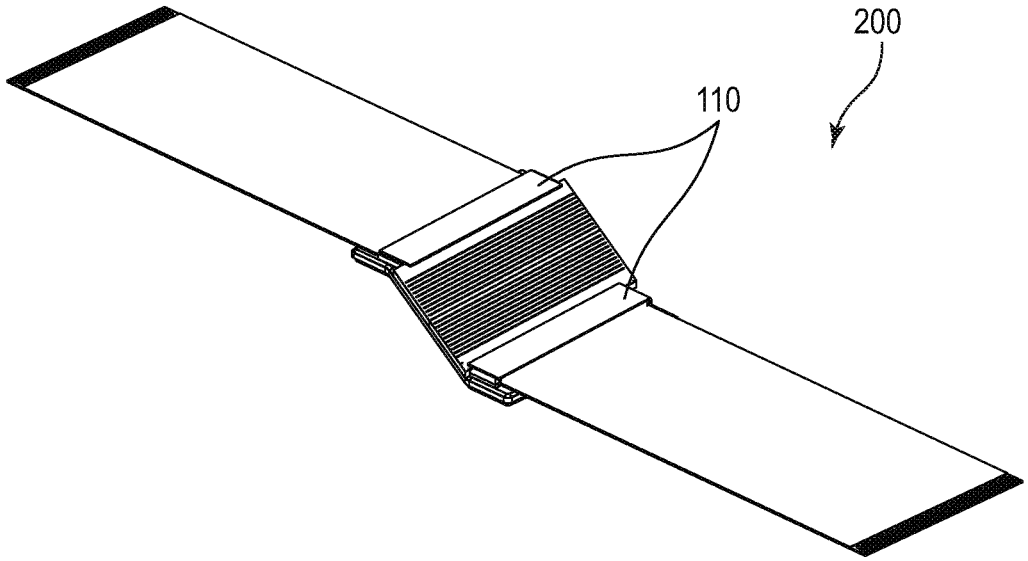
FIGS. 18A and 18B are a perspective view and an exploded perspective view of an ejection module of the liquid ejection head illustrated in FIGS. 13A and 13B.
Figure 18B:
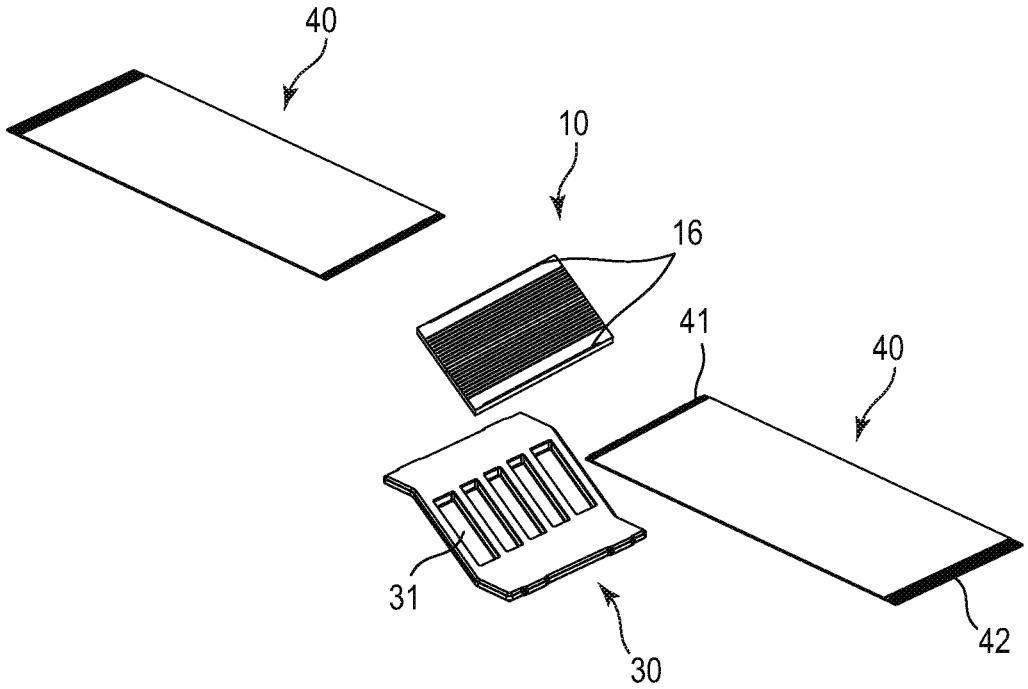

A perspective view of one ejection module 200 is illustrated in FIG. 18A, and an exploded view thereof is illustrated in FIG. 18B. Unlike the first application example, the plurality of terminals 16 is disposed at each of both side parts (each of long side parts of the recording element substrate 10) along the plurality of ejection orifice line directions of the recording element substrate 10, and two flexible wiring substrates 40 to be electrically connected to the terminals 16 are also disposed with respect to one recording element substrate 10. This is because the number of ejection orifice lines to be provided in the recording element substrate 10 is 20 lines, for example, and is increased to be markedly larger than the eight lines of the first application example. That is, this is because a maximum distance from the terminals 16 to the energy generating elements 14 provided to correspond to the ejection orifice lines is shortened to reduce voltage drop or signal transmission delay that is caused in the wiring parts within the recording element substrate 10. Additionally, the liquid communication ports 31 of the support member 30 are open so as to straddle all the ejection orifice lines provided in the recording element substrate 10. Other points are the same as those of the first application example.

(Description of Structure of Recording Element Substrate)

Figure 19A:
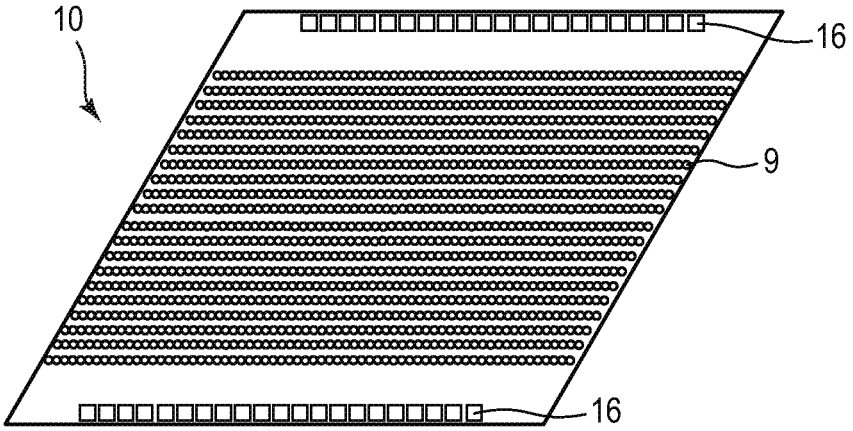
FIGS. 19A, 19B and 19C are a plan view, an intermediate view, and a bottom view of the recording element substrate of the liquid ejection head illustrated in FIGS. 13A and 13B.
Figure 19B:
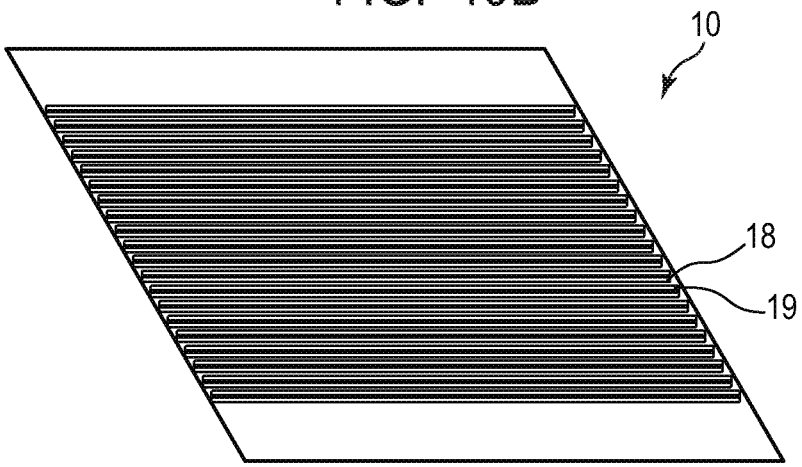
Figure 19C:
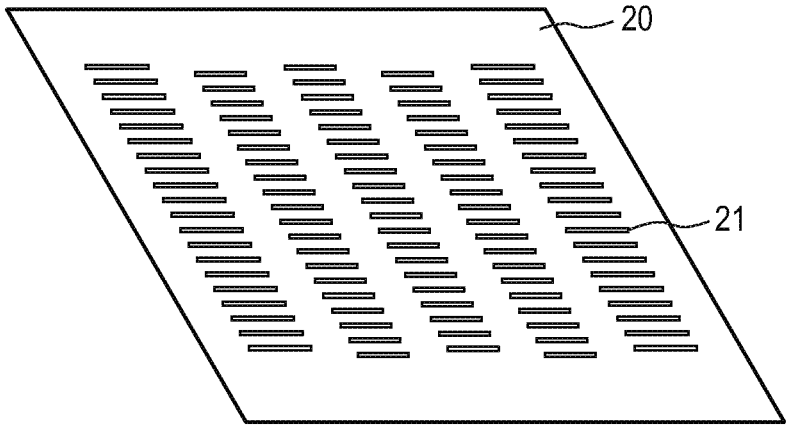

FIG. 19A is a schematic view illustrating the surface of the recording element substrate 10 in which ejection orifices 9 are disposed, and FIG. 19C is a schematic view illustrating a back surface of the surface of FIG. 19A. FIG. 19B is a schematic view illustrating the surface of the recording element substrate 10 in a case where the lid member 20 provided on a back surface side of the recording element substrate 10 is removed in FIG. 19C. As illustrated in FIG. 19B, the supply flow paths 18 and the recovery flow paths 19 are alternatively provided along the ejection orifice line direction on a back surface of the recording element substrate 10. Although the number of ejection orifice lines is markedly larger than that in the first application example, an essential difference from the first application example is that the terminals 16 are disposed at both the side parts along the ejection orifice line direction of the recording element substrate as mentioned above. The basic configurations, such as the set of the supply flow path 18 and the recovery flow path 19 being provided for each ejection orifice line and the lid member 20 being provided with the openings 21 that communicate with the liquid communication ports 31 of the support member 30, are the same as those of the first application example.

<Modification Example of Configuration of Liquid Ejection Head>

Figure 30:
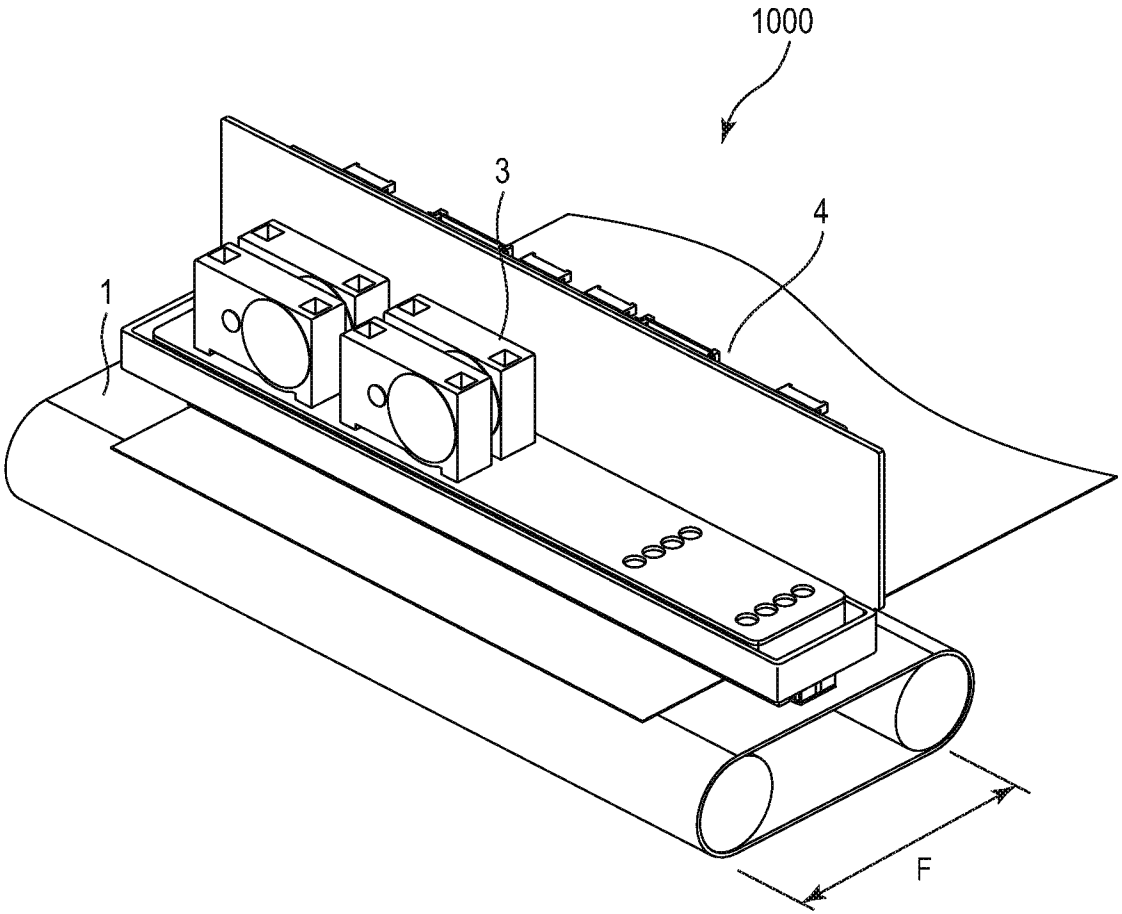
FIG. 30 is a perspective view illustrating a schematic configuration of the liquid ejection apparatus.
Figure 31A:
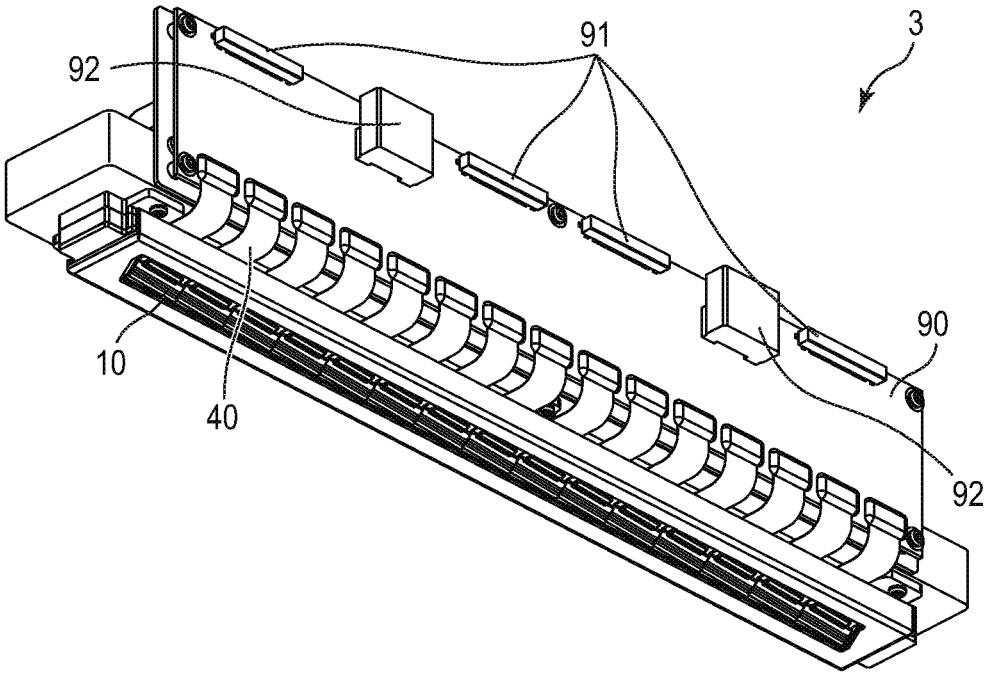
FIGS. 31A and 31B are perspective views of a liquid ejection head.
Figure 31B:
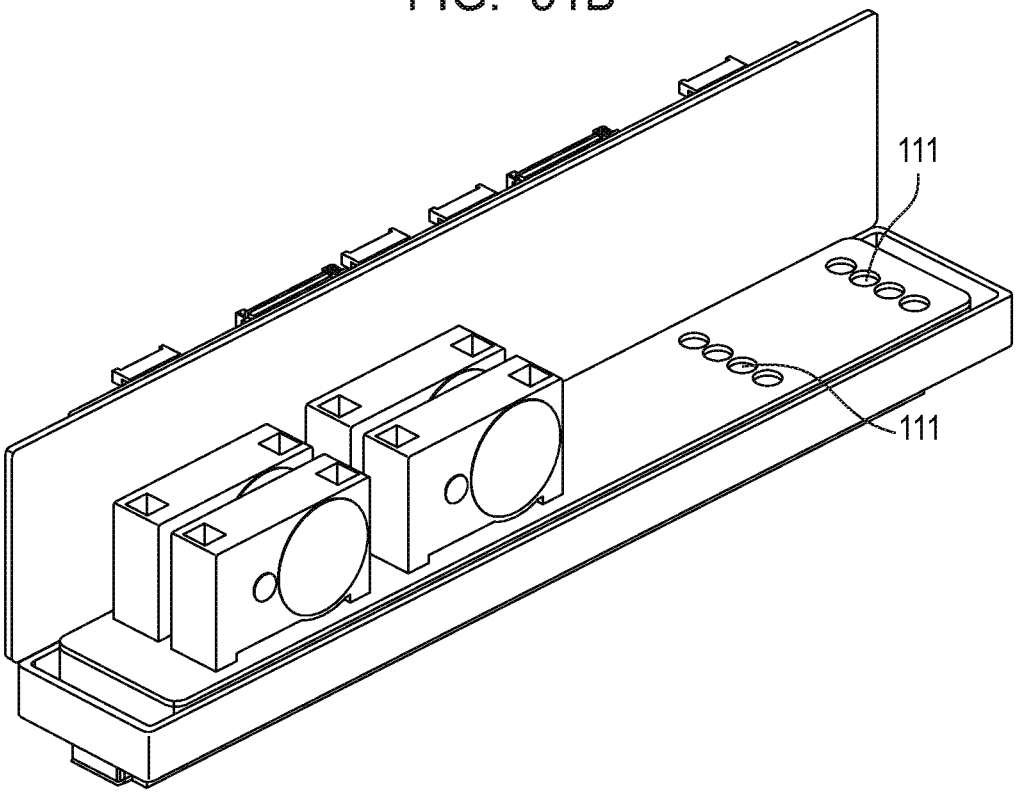
Figure 32:
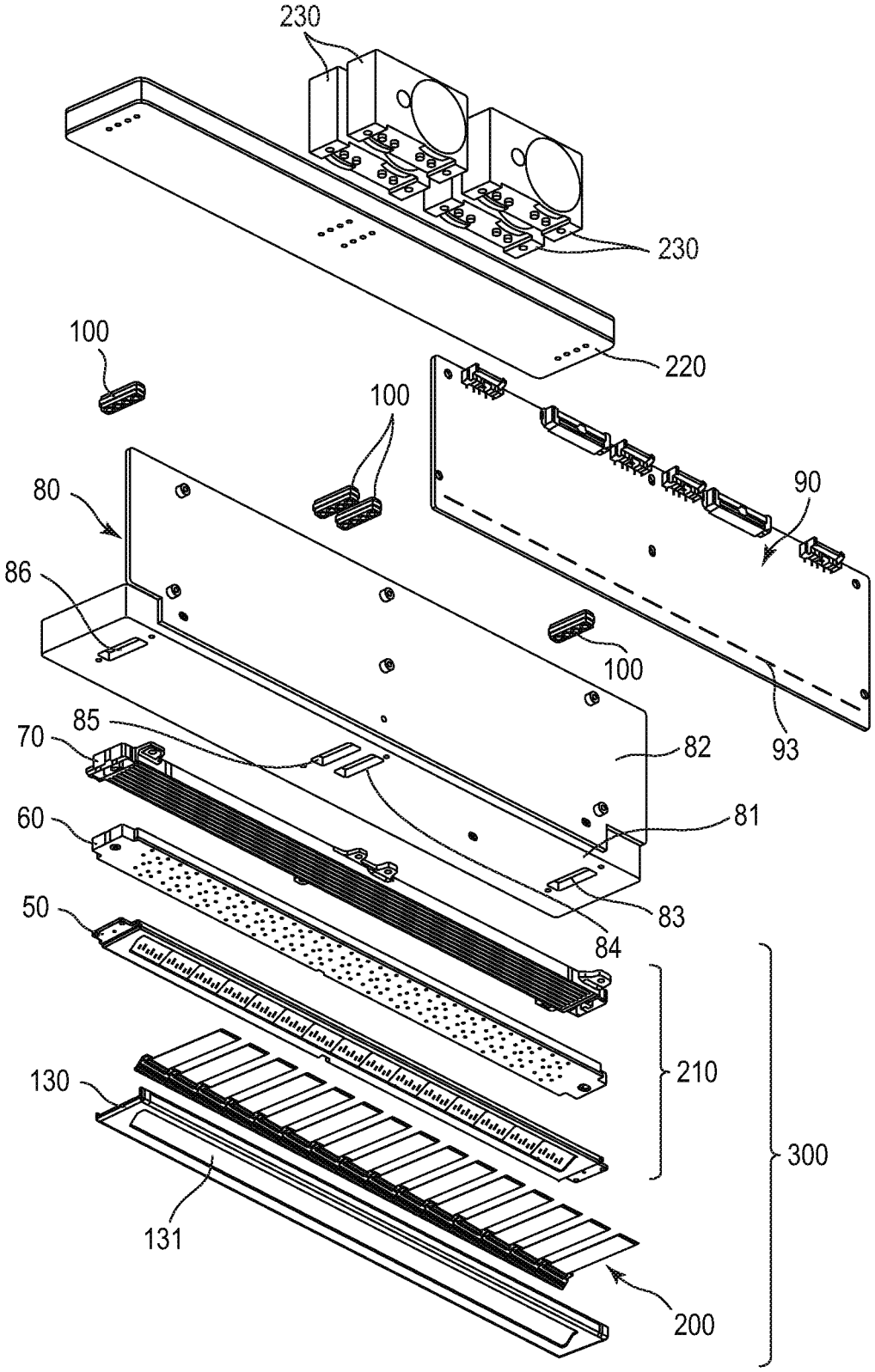
FIG. 32 is an exploded perspective view of the liquid ejection head.

A modification example (third application example) of the configuration of the above-described liquid ejection head will be described with reference to FIGS. 30 to 33. The description of the same configurations and functions as those of the above-described example will be omitted, and differences will be actively described. In the present example, as illustrated in FIG. 30, FIG. 31A and FIG. 31B, a plurality of liquid connection units 111, which are liquid connection parts between the liquid ejection head 3 and the outside is disposed in a concentrated manner on one end side of the liquid ejection head in the longitudinal direction. The plurality of negative-pressure control units 230 is disposed in a concentrated manner on the other end side of the liquid ejection head 3 (FIG. 32). The liquid supply unit 220 included in the liquid ejection head 3 is constituted as an elongated unit corresponding to the length of the liquid ejection head 3, and includes flow paths and filters 221 corresponding to liquids of four colors to be supplied. As illustrated in FIG. 32, the positions of the opening 83 to an opening 86 provided in the liquid ejection unit support part 81 are also provided at positions different from the above-described liquid ejection head 3.

Figure 33:
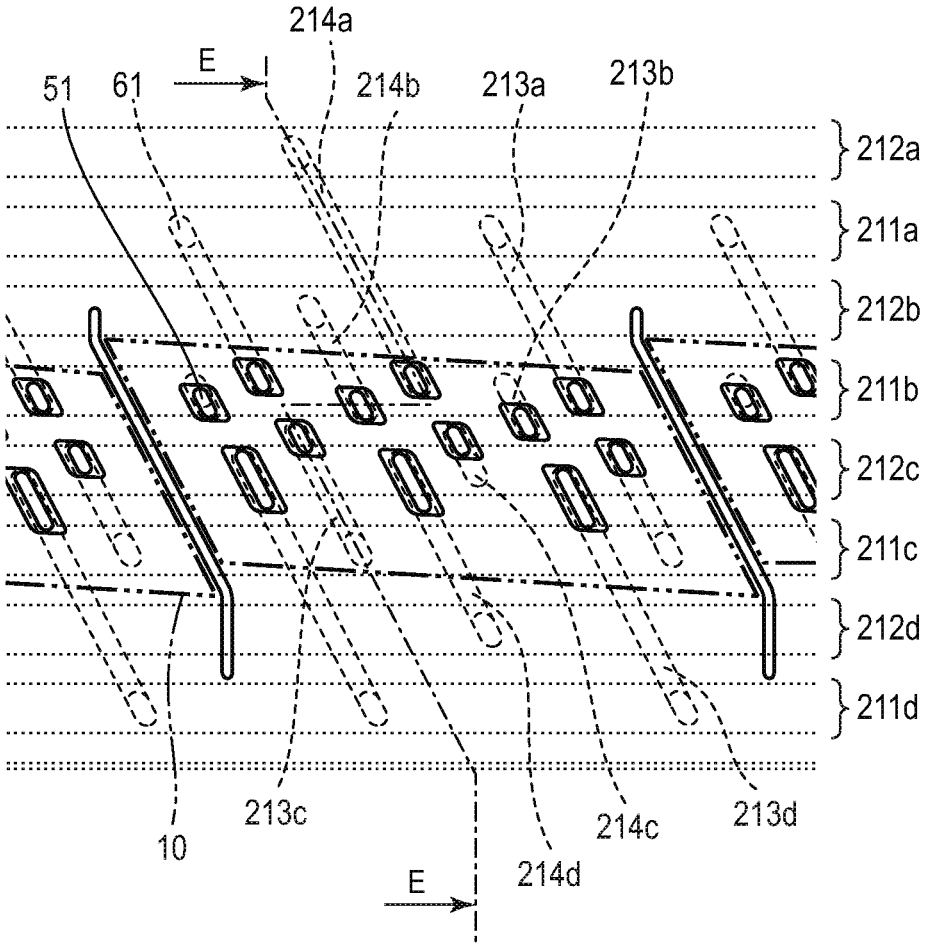
FIG. 33 is a perspective view of a flow path member.

A laminated state of the flow path members 50, 60 and 70 is illustrated in FIG. 33. The plurality of recording element substrates 10 is linearly arranged on an upper surface of the flow path member 50 that is a top layer of the plurality of flow path members 50, 60 and 70. As for the flow paths that communicate with the openings 21 (FIGS. 19A to 19C) formed on the back surface side of each recording element substrate 10, two individual supply flow paths 213 and one individual recovery flow path 214 are provided for every color of the liquid. Correspondingly, as for the openings 21 formed in the lid member 20 provided on the back surface of the recording element substrate 10, two openings 21 for supply and one opening 21 for recovery are also provided for each color of the liquid. As illustrated in FIG. 33, the common supply flow path 211 and the common recovery flow path 212 are alternately disposed in parallel in the longitudinal direction of the liquid ejection head 3.

(Circulation of Ink and Ink with Small Moisture Content)

Hereinafter, with regard to the liquid ejection head described until now, the circulation of the ink and small moisture content ink with small moisture content will be described.

(Description in the Vicinity of Nozzle)

Figure 20A:
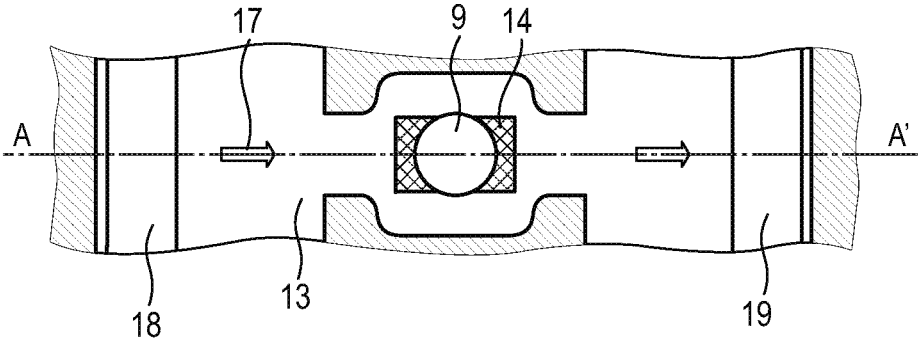
FIGS. 20A, 20B and 20C are schematic views illustrating main parts of the liquid ejection head.
Figure 20B:
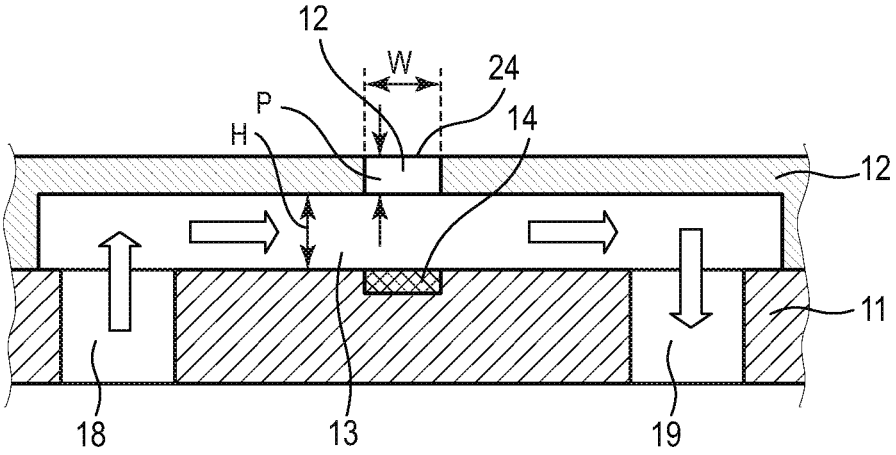
Figure 20C:
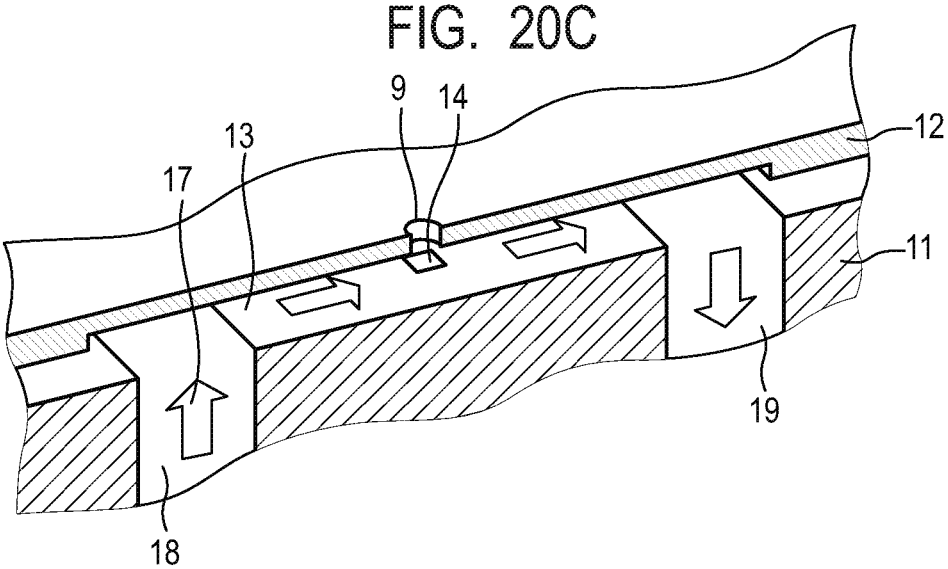

FIGS. 20A to 20C are schematic views illustrating the vicinity of the ejection orifice of the liquid ejection head that ejects the liquid, such as the ink, in the present embodiment in detail. FIG. 20A is a plan view as seen from an ejection direction in which droplets are ejected from the ejection orifice, FIG. 20B is a sectional view taken along A-A' in FIG. 20A, and FIG. 20C is a perspective view of a section taken along A-A' of FIG. 20A.

In FIGS. 20A to 20C, the ejection orifice 9, which ejects the liquid, a flow path 13, and an energy generating element 14, which is formed in the flow path 13 to generate the energy to be used in order to eject the liquid are formed in the liquid ejection head 3 (refer to FIG. 3). The flow path 13 includes the liquid inside thereof. Ink supply is performed from one end side to the other end side in the flow path 13, and the ejection orifice 9 is formed in a region between the one end side and the other end side of the flow path. The meniscus of the ink is stretched in the ejection orifice 9, and an ejection orifice interface 24, which is an interface between the ink and the ambient air, is formed in the ejection orifice 9. By driving an electric heat conversion element (heater) that is the energy generating element 14, a bubble is generated in the liquid to eject the liquid from the ejection orifice 9. Although an example in which the heater is applied as the energy generating element has been described in the present embodiment, the present disclosure is not limited to this. For example, various energy generating elements, such as a piezoelectric element, are applicable. The supply flow path 18 and the recovery flow path 19, which extend in a direction intersecting the flow path 13, are formed as through holes in the liquid ejection head. Moreover, the supply flow path 18 communicates with a third common supply flow path (supply opening) that is an inlet for the liquid from the outside to the liquid ejection head, and the recovery flow path 19 communicates with a third common recovery flow path (recovery opening) that is an outlet for the liquid from the liquid ejection head to the outside. In this way, a flow path along which the liquid is supplied is formed in order of the third common supply flow path (supply opening), the supply flow path 18, the flow path 13, the ejection orifice 9, the flow path 13, the recovery flow path 19, and the third common recovery flow path (recovery opening), in the liquid ejection head 3. In the present embodiment, as will be described below, a so-called circulation path along which the liquid recovered from the third common recovery flow path (recovery opening) to the outside of the liquid ejection head is again supplied to the third common supply flow path of the liquid ejection head is formed, and a circulatory flow 17 is formed in the liquid ejection head. In the present embodiment, the energy generating element 14 is driven to eject droplets from the ejection orifice 9 in a state where the ink flows to the flow path 13. The velocity of a circulatory flow that flows through the flow path 13 is, for example, 0.1 mm/s or more to 100 mm/s or less, and even if an ejection operation is performed in a state where the ink flows, there is little influence on the landing accuracy or the like.

In FIG. 20B, the energy generating element 14 is formed in the substrate 11 made of silicon (Si), and the ejection orifice 9, which ejects the liquid, and an ejection orifice part 2, which allows the ejection orifice 9 and the flow path 13 to communicate with each other, is formed in the ejection orifice forming member 12. That is, the ejection orifice is an opening part that is formed in a front surface (a surface from which droplets are ejected) of the ejection orifice forming member 12, and the ejection orifice part indicates a tubular portion that connects the ejection orifice 9 and the flow path 13 to each other.

(Relationship Between P, W and H)

As described above, in the present disclosure, the liquid inside the flow path in which the energy generating element is disposed (provided) is circulated between the inside of the flow path and the outside of the flow path. Next, a relationship between the height of the flow path of the liquid ejection head, the thickness of an orifice plate, and the length of an ejection orifice in the present embodiment, and a method of supplying the ink in the liquid ejection head will be described.

As illustrated in FIG. 20B, the height of the flow path 13 on an upstream side in the flow direction of the liquid within the flow path 13 in a communication portion between the flow path 13 and the ejection orifice part 2 is defined as H [μm], and the length of the ejection orifice part 2 in a direction in which the liquid is ejected from the ejection orifice 9 is defined as P [μm]. Additionally, the length of the ejection orifice part 2 in the flow direction of the liquid within the flow path 13 is defined as W [μm]. In the present embodiment, H is set to 3 to 30 [μm], P is set to 3 to 30 [μm], and W is set to 6 to 30 [μm], and ink in which nonvolatile solvent concentration is 30%, coloring material concentration is 3%, and viscosity is adjusted to 0.002 to 0.003 Pa·s is used.

Figure 21:
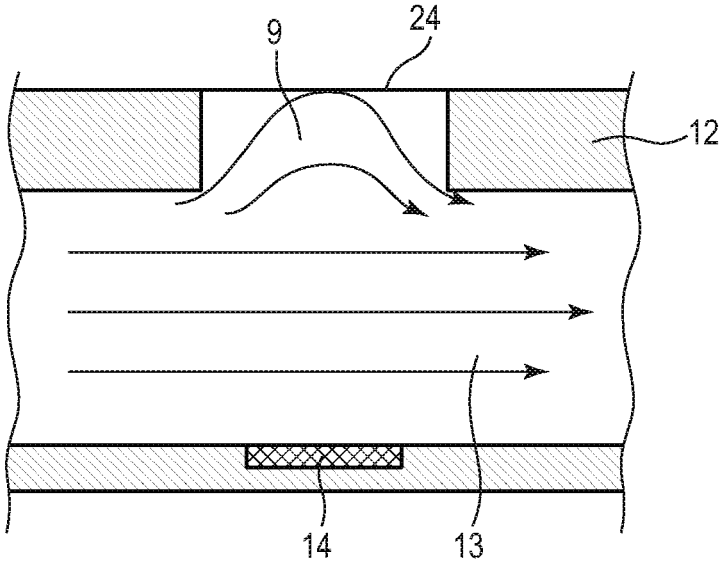
FIG. 21 is a schematic view illustrating an example of a flow aspect of a liquid in the vicinity of an ejection orifice part of the liquid ejection head.

FIG. 21 is a view illustrating a flow aspect of the circulatory flow 17 in the ejection orifice 9, the ejection orifice part 2 and the flow path 13 when the circulatory flow 17 of the ink that flows through the inside of the liquid ejection head 3 is brought into a steady state. In addition, in this view, the length of a vector does not represent the amount of velocity and is constant with respect to all velocity values. FIG. 21 illustrates a flow when the ink having a flow rate of $1.26\times10^{-4}$ ml/min is supplied to the flow path 13 from the supply flow path 18, in a liquid ejection head in which H is 14 [μm], P is 5 [μm], and W is 12.4 [μm] in an arrow.

In the present embodiment, the following configuration is provided so that the ink in which a coloring material concentration change has occurred due to the evaporation of the ink from the ejection orifice is suppressed from stagnating in the ejection orifice 9 and the ejection orifice part 2. That is, in the liquid ejection head of the present embodiment, as illustrated in FIG. 21, there is formed a circulatory flow in which the circulatory flow 17 of the ink, which flows through the inside of the flow path 13, flows into the ejection orifice part 2, reaches the vicinity of the ejection orifice interface 24, and then, returns to the flow path 13 again through the ejection orifice part 2. The ink, which has returned to the flow path 13, is recovered from the third common recovery circuit via the recovery flow path 19 to the outside of the liquid ejection head. In this way, there is formed a flow in which the circulatory flow enters the inside of the ejection orifice part 2, reaches the meniscus position (the vicinity of a meniscus interface) formed in the ejection orifice, and then, returns to the flow path 13 again. Accordingly, the ink not only inside the ejection orifice part 2 that is likely to be influenced by the evaporation but also in the vicinity of the ejection orifice interfaces 24 in which the influence of the evaporation is particularly remarkable is capable of flowing out to the flow path 13 without stagnating inside the ejection orifice part 2.

Here, the circulatory flow 17 of the present embodiment has a velocity component (hereinafter referred to as a positive velocity component) in a flow direction (a direction from the left toward the right in FIG. 21) of the ink within the flow path 13 at least at a central part (a central part of the ejection orifice) in the vicinity of the ejection orifice interface 24. In addition, in the present specification, the mode of a flow in which the circulatory flow 17 has the positive velocity component at least at the central part of the ink interface 24 as illustrated in FIG. 21 is referred to as a "flow mode A". Additionally, as will be described below, as FIGS. 23B to 23D illustrated as a comparative example, the mode of a flow with a negative velocity component in a direction opposite to the positive velocity component (right to left direction in FIG. 23B) at the central part of the ejection orifice interface 24 is referred to as a "flow mode B".

It can be seen through the present inventors' study that the liquid ejection head of the flow mode A in the present embodiment satisfies the following expression in order to reduce stagnation of the ink in which the coloring material concentration change has occurred due to the evaporation in the ejection orifice 9. That is, a flow path height H (a flow path height in the vicinity of an upstream side of a spot where the flow path 13 and the ejection orifice part 2 communicate with each other), an ejection orifice length P, and the width W of the ejection orifice in FIG. 20B satisfy the following Relational Expression (1).

$$H^{-0.34}\times P^{-0.66}\times W>1.7 \qquad \text{Relational Expression (1)}$$

Here, the left side of the above Relational Expression (1) is referred to as a determination value J. It has been elucidated through our study that the liquid ejection head that satisfies Relational Expression (1) is brought into the flow mode A as illustrated in FIG. 21, and the liquid ejection head of the flow mode B does not satisfy Relational Expression (1). Relational Expression (1) will be described with reference to FIGS. 22 to 24.

Figure 22:
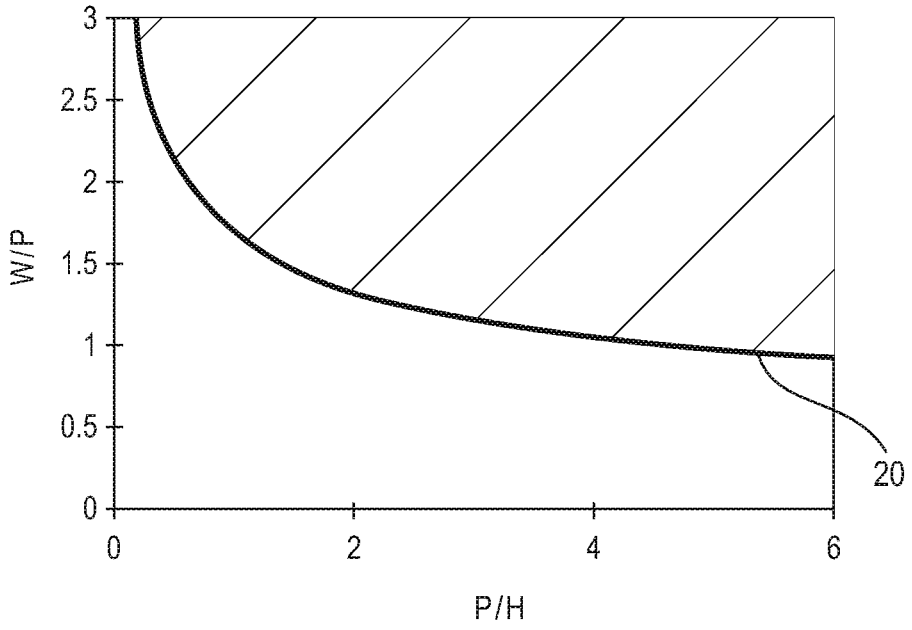
FIG. 22 is a graph illustrating a relationship between P/H and W/P.

FIG. 22 is a view illustrating a relationship between the liquid ejection head brought into the flow mode A, and the liquid ejection head brought into the flow mode B. A horizontal axis of FIG. 22 represents a ratio (P/H) of P and H, and a vertical axis represents a ratio (W/P) of W and P. 20 designates a threshold line and a line that satisfies the following Relational Expression (2).

$$\left(\frac{W}{P}\right)=1.7\times\left(\frac{P}{H}\right)^{-0.34} \qquad \text{Relational Expression (2)}$$

Here, as for the relationship between H, P and W, it can be seen that a liquid ejection head in a portion (a region illustrated by hatched lines) above the threshold line 20 of FIG. 22 is brought into the flow mode A, and a liquid ejection head in a portion below the threshold line 20 is brought into the flow mode B. That is, the liquid ejection head that satisfies the following Relational Expression (3) is brought into the flow mode A.

$$\left(\frac{W}{P}\right)>1.7\times\left(\frac{P}{H}\right)^{-0.34} \qquad \text{Relational Expression (3)}$$

Since Relational Expression (1) is obtained if Relational Expression (3) is arranged, a head (a head in which the determination value J is 1.7 or more) in which the relationship between H, P and W satisfies Relational Expression (1) is brought into the flow mode A. The above relationship is confirmed using FIGS. 23A to 23D and FIG. 24. Respective liquid ejection heads of FIGS. 23A to 23D show examples of aspects of the circulatory flow 17 in the vicinity of the ejection orifice part 2 in the liquid ejection heads in the portions above and below the threshold line 20 in FIG. 22. FIG. 24 illustrates results obtained by determining whether liquid ejection heads having various supply path shapes are brought into any of the flow mode A or the flow mode B by checking aspects of the flow thereof. In FIG. 24, each filled circle represents a liquid ejection head brought into the flow mode A, and each x represents a liquid ejection head brought into the flow mode B.

Figure 23A:
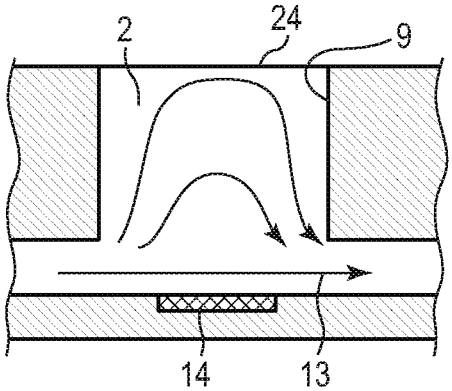
FIGS. 23A, 23B, 23C and 23D are schematic views illustrating examples of flow aspects of the liquid in the vicinity of ejection orifices.
Figure 23B:
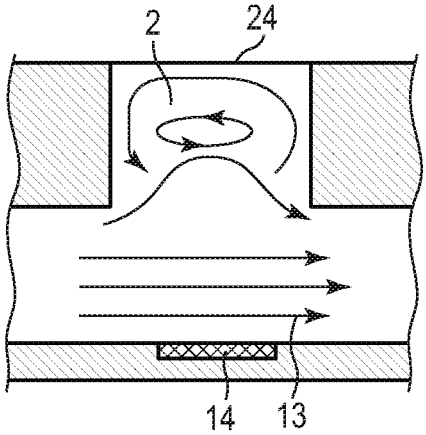
Figure 23C:
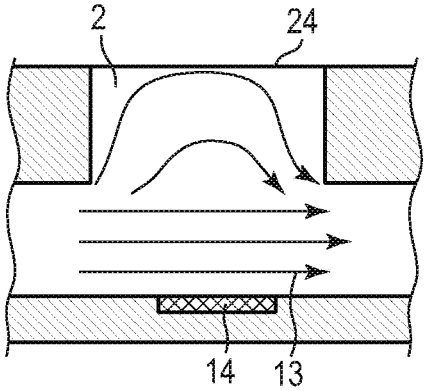
Figure 23D:
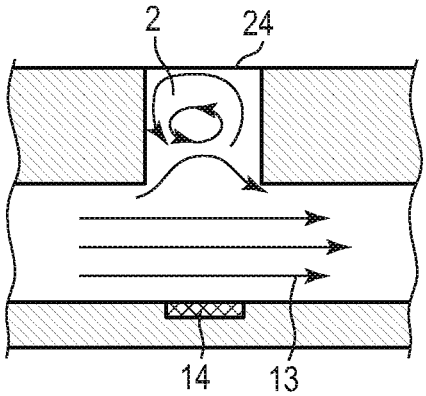
Figure 24:
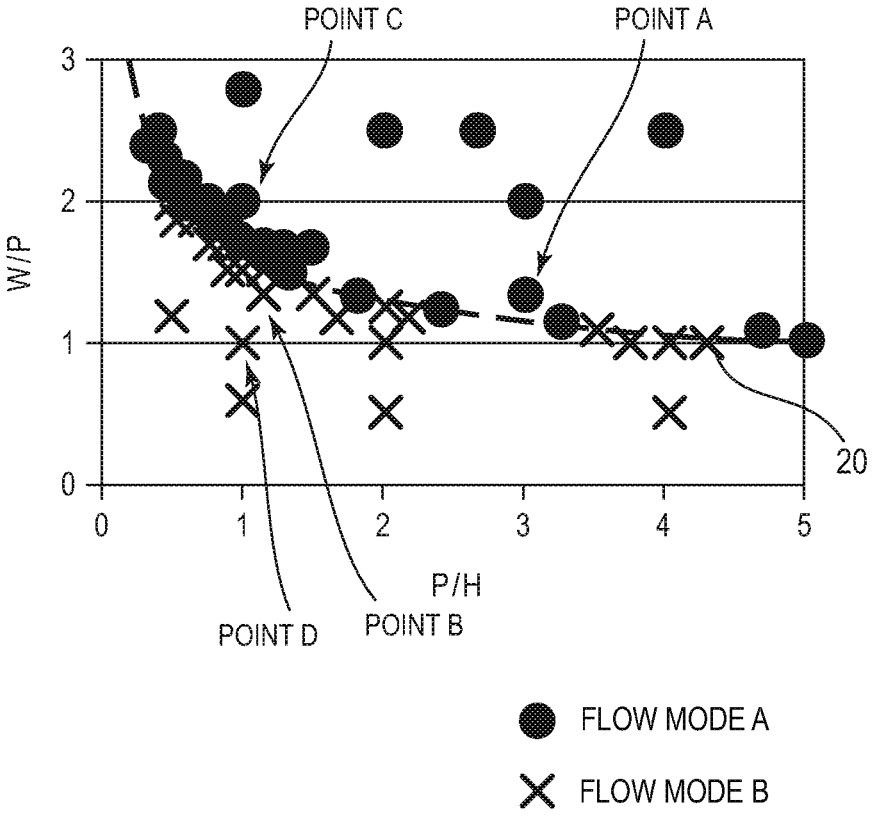
FIG. 24 is a graph illustrating a relationship between P/H and W/P.

FIG. 23A is a liquid ejection head of a shape in which H is 3 [μm], P is 9 [μm], and W is 12 [μm], and the determination value J, which is the left side of Relational Expression (1), becomes 1.93, and is larger than 1.7. When the flow of an actual circulatory flow is checked, the flow mode A is brought about as illustrated in FIG. 23A. In FIG. 24, the liquid ejection head corresponds to Point A. Next, FIG. 23B is a liquid ejection head of a shape in which H is 8 [μm], P is 9 [μm], and W is 12 [μm], and the determination value J becomes 1.39, and is smaller than 1.7. The flow of the actual circulatory flow is also brought into the flow mode B. In FIG. 24, the liquid ejection head corresponds to Point B. FIG. 23C is a liquid ejection head of a shape in which H is 6 [μm], P is 6 [μm], and W is 12 [μm], and the determination value J becomes 2.0, and is larger than 1.7. The flow of the actual circulatory flow is also brought into the flow mode A. In FIG. 24, the liquid ejection head corresponds to Point C. Finally, FIG. 23D is a liquid ejection head of a shape in which H is 6 [μm], P is 6 [μm], and W is 6 [μm], and the determination value J becomes 1.0, and is smaller than 1.7. The flow of the actual circulatory flow is also brought into the flow mode B. In FIG. 24, the liquid ejection head corresponds to Point D.

In this way, the liquid ejection head brought into the flow mode A and the liquid ejection head brought into the flow mode B can be divided with the threshold line 20 of FIG. 22 as a boundary. That is, the liquid ejection head in which the determination value J of Relational Expression (1) is larger than 1.7 is brought into the flow mode A, and the circulatory flow 17 has the positive velocity component at least at the central part of the ejection orifice interface 24.

In addition, the conditions of the above P, W and H have dominant influence on whether the flow of the circulatory flow 17 within the ejection orifice is brought into the flow mode A or brought into the flow mode B. In addition to these conditions, for example, influence of conditions, such as the flow velocity of the circulatory flow 17, the viscosity of the ink, and the width (the length of the ejection orifice in a direction orthogonal to W) of the ejection orifice 9 in a direction perpendicular to a flow direction of the circulatory flow 17, is significantly small compared to P, W and H. Hence, circulation flow velocity or the viscosity of ink may be appropriately set in conformity with required specification of the liquid ejection head (ink jet recording apparatus) or environmental conditions to be used. Additionally, in a case that the amount of evaporation of the ink from the ejection orifice is increased due to an environmental change or the like in use, the flow mode A can be brought about by appropriately making the flow rate of the circulation flow 17 larger. Even if the flow rate is increased for the liquid ejection head of the flow mode B, the flow mode A is not brought about. That is, whether the mode A is brought about or the flow mode B is brought about is dominated not by the flow velocity of the ink, or the conditions of the viscosity of the ink but by the relationship between H, P and W of the above-described liquid ejection head. Additionally, among various liquid ejection heads brought into the flow mode A, particularly a liquid ejection head in which H is 20 [μm] or less, P is 20 [μm] or less, and W is 30 [μm] or less allows higher-definition image formation, and is thus preferred.

Although Relational Expression (1) is $H^{-0.34}\times P^{-0.66}\times W>1.7$ . . . Relational Expression (1), in the present disclosure, even by satisfying the following Relational Expression (4), the ink, which flows through the inside of the flow path, flows into the ejection orifice part, reaches a position of at least half of the orifice plate thickness of the ejection orifice part, and then returns to the flow path again.

$$H^{-0.34}\times P^{-0.66}\times W>1.5 \qquad \text{Relational Expression (4)}$$

However, it is more preferable to satisfy Relational Expression (3) from the viewpoint of the circulation.

(Relationship Between P, W, H, and Ink with Small Moisture Content)

Figure 25:
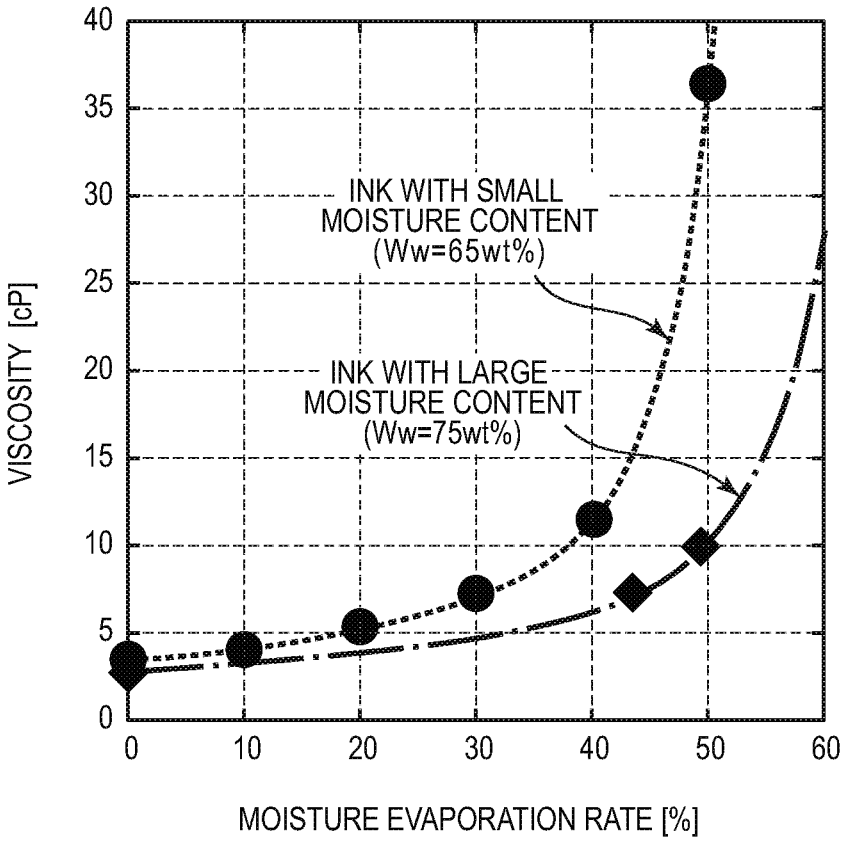
FIG. 25 is a graph illustrating a relationship between the moisture evaporation amount and viscosity of ink.

As long as aqueous pigment ink is used, particularly when the recording medium is a regular paper, problems, such as curling and cockling, are likely to occur. As a countermeasure against such a problem, there is a unit for ejecting ink with a reduced moisture content. FIG. 25 is a view illustrating changes in viscosity of ink with a relatively small moisture content of 65 wt % (ink with a small moisture content) and ink with a relatively large moisture content of 75 wt % (ink with a large moisture content) with respect to the rate of moisture evaporation. As illustrated in FIG. 25, in the ink with a small moisture content, the concentration of a solvent and solid components (pigment, resin emulsion, resin, and the like) becomes high. Therefore, a rapid viscosity rise occurs along with the moisture evaporation. Particularly, if the amount of the solid components in the liquid is 10 wt % or more, the viscosity rise is likely to occur. The rapid viscosity rise prevents oozing or strike-through on a paper surface, and leads to an improvement in high-speed printing performance and double-sided compatibility as an office printer. On the other hand, within the ejection orifice, the viscosity rises along with the evaporation of the ink from the ejection orifice. Therefore, in that state, color unevenness of an image is likely to occur. In contrast, by circulating the liquid inside the flow path (pressure chamber) where the energy generating element is disposed between the inside and the outside of the flow path, that is, generating the circulatory flow, the viscosity rise of the ink within the flow path (pressure chamber) can be suppressed.

Figure 26A:
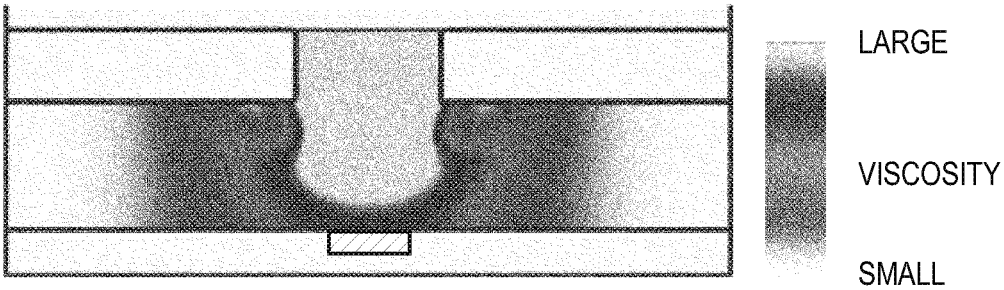
FIGS. 26A, 26B and 26C are views illustrating viscosity (concentration) distributions within a pressure chamber.
Figure 26B:
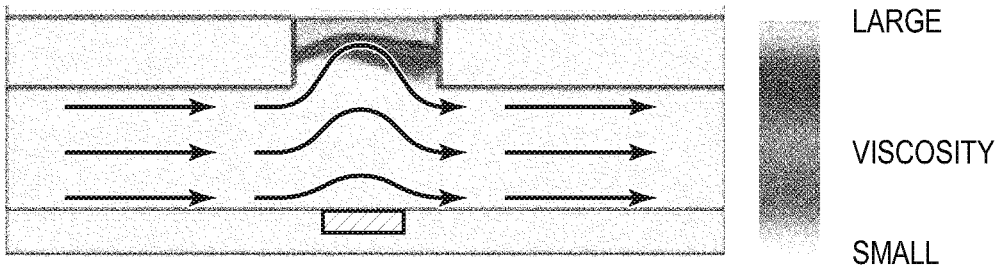
Figure 26C:
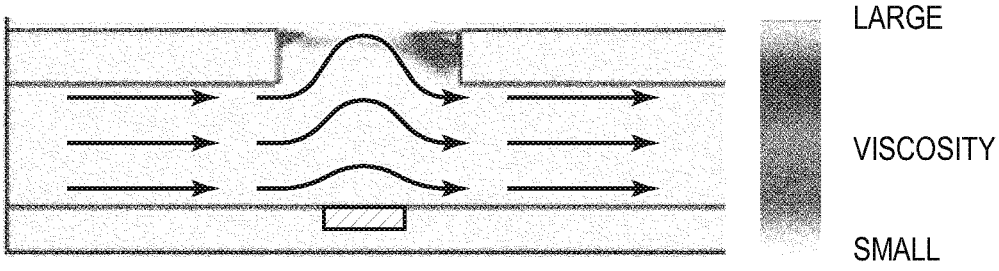

FIGS. 26A, 26B, and 26C are respectively views illustrating concentration distributions within a pressure chamber. Even in any case, the ink is ink (a solid content of 10 wt %, a solvent 30 wt %, and a moisture content of 60 wt %) with a small moisture content. The concentration distribution is expressed by the magnitude of the viscosity. FIG. 26A illustrates a concentration result of a circulatory flow of 0 mm/s under the conditions of the flow mode B with P=8 [μm], W=16 [μm], and H=16 [μm], and Determination value J=1.58. FIG. 26B illustrates a concentration result of a circulatory flow of 1 mm/s under the conditions of the flow mode B with P=8 [μm], W=16[μm], and H=16 [μm], and Determination value J=1.58. FIG. 26C illustrates a concentration result of a circulatory flow of 1 mm/s under the conditions of the flow mode A with P=6 [μm], W=16 [μm], and H=18 [μm], and Determination value J=2.15.

As illustrated in FIG. 26A, in a case where there is no circulatory flow in the ink with a small moisture content, the ink in which concentration has proceeded is diffused from the ejection orifice side, and the concentration has proceeded to the inside of the pressure chamber. Since the increase in viscosity of the ink with a small moisture content is large during the moisture evaporation, it is difficult to maintain normal ejection if such a state is brought about. On the other hand, in the case of the ink with a large moisture content, the ink from the flow path to the ejection orifice is concentrated similarly. However, since the increase in viscosity during the moisture evaporation is small as illustrated in FIG. 25, the influence on the ejection is small.

As illustrated in FIG. 26B, in a case where a circulatory flow is generated in the ink with a small moisture content, the circulatory flow is supplied to the inside of the pressure chamber and a portion of the ejection orifice. Therefore, concentration is suppressed. Hence, in the case of ink with a small moisture content, the ink is circulated through the inside of the pressure chamber, and particularly a unit for supplying the circulatory flow to the inside of the ejection orifice is effective. However, if the flow of the circulatory flow is the flow mode B, it is difficult for the circulatory flow to flow up to the meniscus position (in the vicinity of the meniscus interface) formed in the ejection orifice. Also, since the increase in viscosity during the moisture evaporation is large, the concentration in the vicinity of the meniscus interface remains, and the ink is increased in viscosity. Moreover, in the case of the ink with a small moisture content, there is a case where it is difficult to maintain normal ejection after the concentration. In such a case, the flow mode A is preferably set.

As illustrated in FIG. 26C, if a circulatory flow is generated within the ink with a small moisture content, and the flow of the circulatory flow is the flow mode A, it is easy for the circulatory flow to flow into the meniscus position (in the vicinity of the meniscus interface) formed in the ejection orifice. For that reason, even if the increase in viscosity during the moisture evaporation is large, the ink concentration in the vicinity of the meniscus interface is suppressed. Hence, in the case of the ink with a small moisture content, it can be seen that the flow mode A is extremely effective in the suppression of the concentration. Moreover, even in the ink with a small moisture content (for example, a moisture content of 55 wt %), the circulatory flow flows into the meniscus position (in the vicinity of the meniscus interface) formed in the ejection orifice. Therefore, it is possible to maintain the normal ejection after the concentration.

In addition, the "ink with a small moisture content" of the present disclosure, is ink in which the content (moisture content) of the moisture that the ink contains is 65 wt % or less. Ink in which the problem is more likely to occur and the effect of the present disclosure is more likely to be exhibited is ink in which the moisture content is 60 wt % or less, and ink in which the problem is still more likely to occur and the effect of the present disclosure is still more likely to be exhibited is ink in which the moisture content is 55 wt % or less.

As described above, in the case of the ink with a small moisture content, circulating the liquid inside the flow path (pressure chamber) where the energy generating element is disposed between the inside and the outside of the flow path is effective in the suppression of concentration. Particularly, the liquid ejection head 3 in which H is 20 [μm] or less, P is 20 [μm] or less, and W is 30 [μm] or less preferably satisfies the above relational expression (4), and more preferably satisfies the above relational expression (1). Accordingly, it is possible to reduce the color unevenness of an image formed even in a case where the moisture content of the ink is small.

The value of the moisture content of above-described ink is the moisture content of the ink in a path from a portion, through which the ink is supplied from the outside to the inside of the liquid ejection head 3, to the ejection orifice 9. However, since the value of the moisture content of the ink in this part is substantially equal to the value of the moisture content of the ink within the main tank 1006 (FIG. 2, FIG. 3), the moisture content within the main tank 1006 may be measured.

Figure 27A:
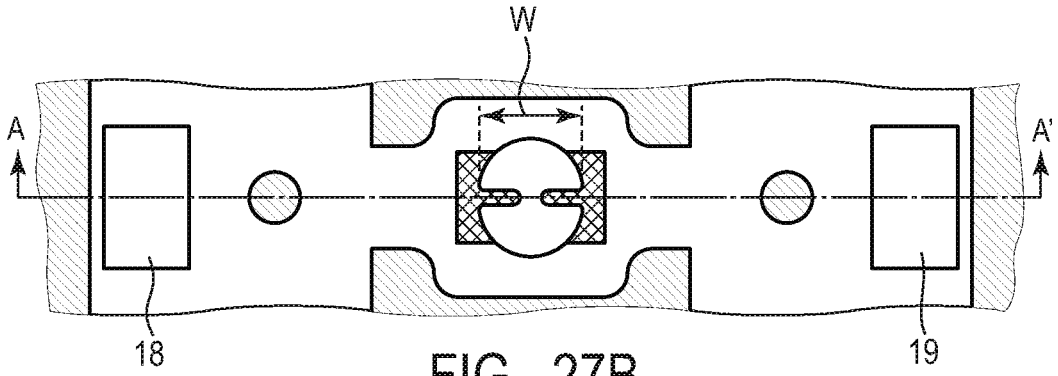
FIGS. 27A, 27B, 27C and 27D are schematic views illustrating main parts of liquid ejection heads.
Figure 27B:
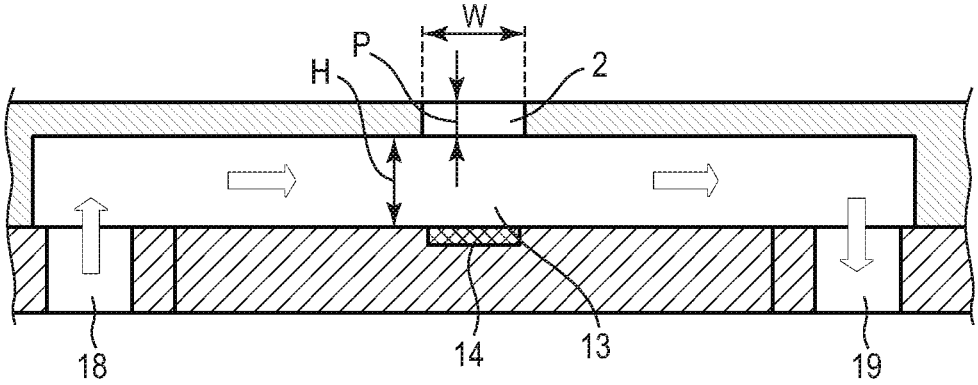
Figure 27C:
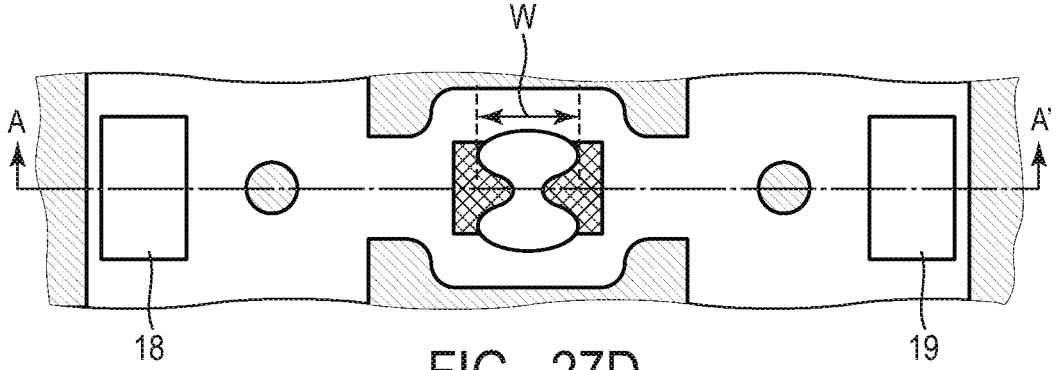
Figure 27D:
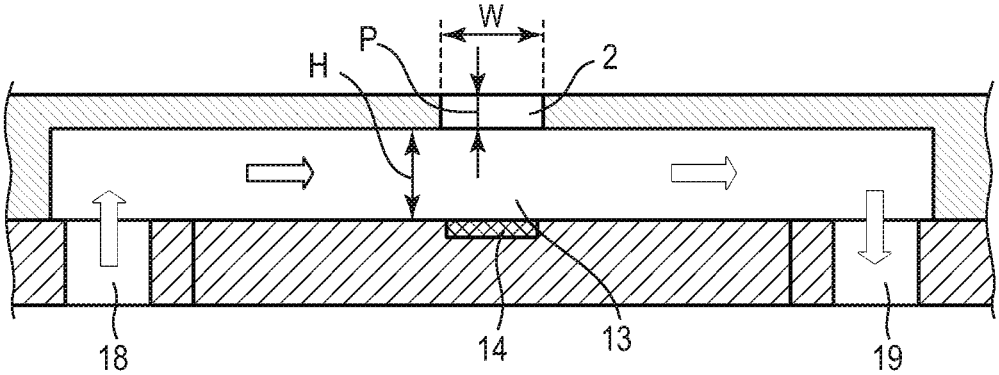

In addition, FIGS. 26A to 26C illustrate the concentration result in the ejection orifice in which the opening as illustrated in FIGS. 20A to 20C has a shape of a true circle. However, in the present disclosure, the shape of the opening of the ejection orifice is not limited to only the true circle. FIG. 27A is a top view of a liquid ejection head having a projection, and FIG. 27B is a sectional view taken along A-A'. Additionally, FIG. 27C is a top view of a liquid ejection head having a projection, and FIG. 27D is a sectional view taken along A-A'. As illustrated in FIGS. 27A to 27D, each projection, which protrudes toward the center (inside) of the ejection orifice, may be located parallel to the circulatory flow.

Figure 28A:
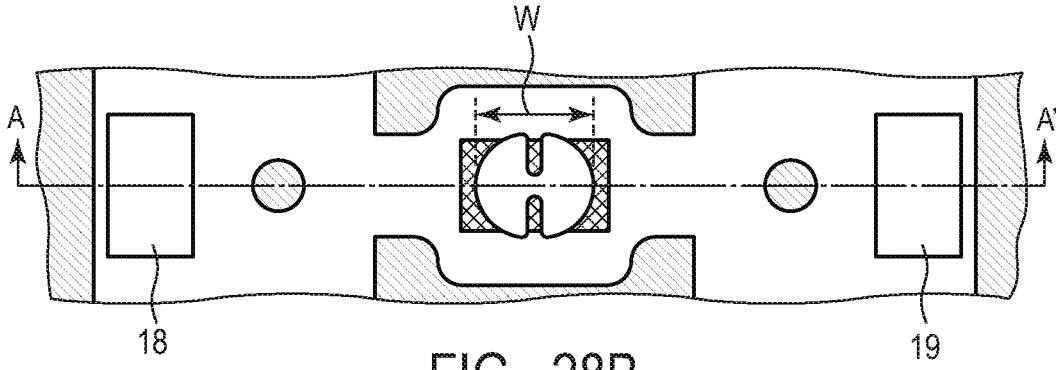
FIGS. 28A, 28B, 28C and 28D are schematic views illustrating main parts of liquid ejection heads.
Figure 28B:
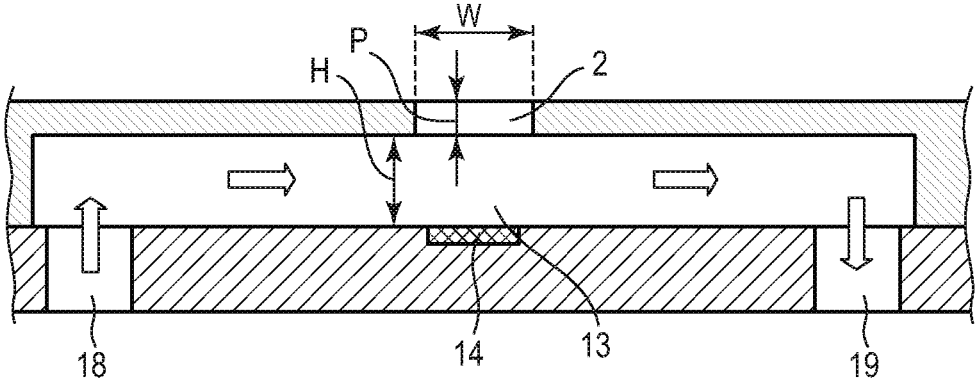
Figure 28C:
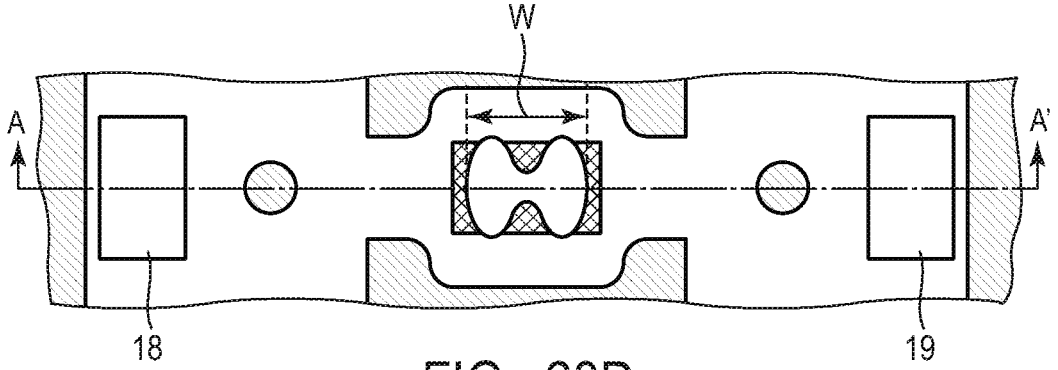
Figure 28D:
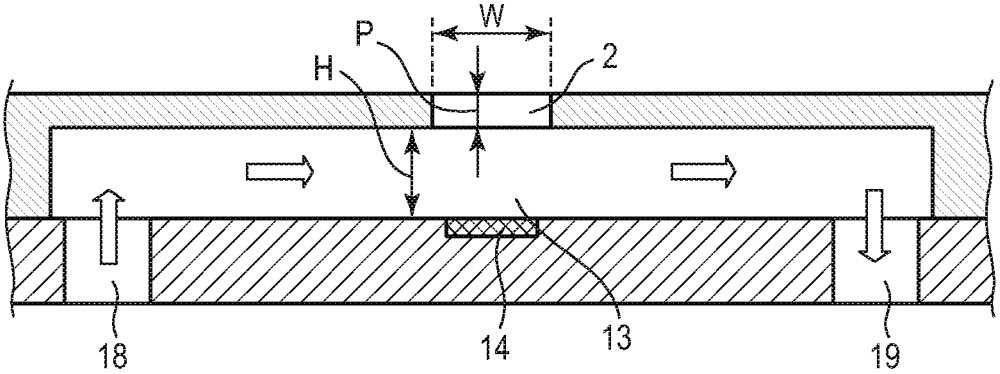

Additionally, FIG. 28A is a top view of a liquid ejection head having a projection, and FIG. 28B is a sectional view taken along A-A'. Additionally, FIG. 28C is a top view of a liquid ejection head having a projection, and FIG. 28D is a sectional view taken along A-A'. As illustrated in FIGS. 28A to 28D, each projection may be located at right angles to the circulatory flow. In any case, the definitions of P, W and H required for flow mode A are as illustrated in FIGS. 27A to 27D and 28A to 28D.

Additionally, methods of circulating the ink within the pressure chamber include a pressure difference system of providing a pressure difference between two flow paths as illustrated in FIG. 2 and FIG. 3, and a so-called micro pump system in which a micro-actuator is provided as the power source (pump) for the circulation within the flow path of the recording element substrate 10. Although the present disclosure is established by any system, the pressure difference system is preferably used from a viewpoint that stable and high-flow velocity of a circulatory flow is easily realized. However, even in the micro pump system, the present disclosure is preferably applicable by providing an assist function of adding an actuator including a piezoelectric element in addition to the micro-actuator that is a heat generating element to improve the circulation flow velocity. Additionally, the circulation flow velocity can also be improved by increasing the cross-sectional area of the flow path through which the circulatory flow flows and reducing the flow resistance.

Additionally, although an example in which portions of the supply flow path and the recovery flow path are formed in the substrate and these flow paths pass through the substrate is shown, these flow paths do not need to pass through the substrate. For example, these flow paths may be formed only on the substrate.

Additionally, in the above respective embodiments, an example in which a pump, which is a power source that performs circulation, is provided on the body of the liquid ejection apparatus that is the outside of the liquid ejection head, is shown. However, a configuration in which the power source is provided in the liquid ejection head 3 may be adopted. Particularly, a configuration in which the recording element substrate 10 (FIGS. 10A to 10C) including the recording element is provided with a micro pump (micro-actuator) including a heat generating element, a piezoelectric element, or the like may be adopted, or a form in which a pump on the apparatus body side and a micro pump on the head side may be used together may be adopted.

In a case where the micro pump is provided in the recording element substrate, a common liquid chamber (not illustrated) that holds the liquid, a first flow path (not illustrated) that allows the pressure chamber 23 and the common liquid chamber to communicate with each other, and a second flow path (not illustrated) that allows the pressure chamber 23 and the common liquid chamber to communicate with each other are included. A configuration in which the micro pump is provided in the second flow path may be applied. The second flow path can be formed into a substantial U shape flow path having a bent part.

The above effect of the circulation within the pressure chamber is effective particularly with respect to a head that adjusts (temperature-adjusts) the temperature of the ink, especially a head that heats the ink by a heating unit provided in the head. The reason is that, along with an increase in ink (head) temperature, the moisture evaporation amount of the ejection orifice increases, and an environment in which the viscosity is easily increased is caused. As the heating unit, a heat generating element may be provided separately from the energy generating element for ejecting the ink, and the energy generating element may also be used as the heating unit.

The present disclosure is also directed to a liquid ejection method using the above described liquid ejection head.

That is, according to the present disclosure, there is provided a liquid ejection method including using a liquid ejection head to eject a liquid, the liquid ejection head including:

an ejection orifice for ejecting a liquid;

a flow path in which an energy generating element, which generates an energy to be used for ejecting the liquid, is disposed;

an ejection orifice part that allows the ejection orifice and the flow path to communicate with each other;

a supply flow path for supplying the liquid from the outside; and a recovery flow path for recovering the liquid to the outside, wherein a moisture content of the liquid is 65 wt % or less, wherein the liquid inside the flow path is circulated between the inside and the outside of the flow path, and wherein in a case where a height of the flow path on an upstream side in a flow direction of the liquid within the flow path is H [μm], a length of the ejection orifice part in a direction in which the liquid is ejected from the ejection orifice is P [μm], and a length of the ejection orifice part in the flow direction of the liquid within the flow path is W [μm] in a communication part between the flow path and the ejection orifice part, $$H^{-0.34}\times P^{-0.66}\times W>1.5$$

is satisfied.

As materials for stabilizing the dispersion of the pigment, there are a self-dispersible pigment utilizing the electrostatic repulsion of pigment particles, and a resin-dispersible pigment utilizing steric hindrance resulting from resin adsorption. In a case where the moisture evaporates and pigment concentration rises, the distance between the particles of the pigments decreases. In that case, in the resin-dispersible pigment, the resin causes inhibition and does not aggregate easily. However, the self-dispersible pigment does not cause inhibition and aggregates easily. Hence, the viscosity rise of the self-dispersible pigment during the moisture evaporation is larger than that of the resin-dispersible pigment. Thus, in a case where the pigment that ink contains is the self-dispersible pigment, the effect of the concentration suppression resulting from the circulation within the pressure chamber is larger than that of the resin-dispersible pigment. Particularly in the case of the ink with small moisture content, the ink is likely to be influenced by the concentration during the moisture evaporation. Therefore, in a case where the self-dispersible pigment is contained, the effect of the concentration suppression resulting from the circulation within the pressure chamber increases.

While the present disclosure has been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-190402, filed Oct. 5, 2018, which is hereby incorporated by reference herein in its entirety.

What is claimed is:

1. A liquid ejection head comprising:

an ejection orifice for ejecting a liquid;

a flow path in which an energy generating element, which generates an energy to be used for ejecting the liquid, is disposed;

a liquid inside the flow path;

an ejection orifice part that allows the ejection orifice and the flow path to communicate with each other;

a supply flow path for supplying the liquid from the outside; and a recovery flow path for recovering the liquid to the outside, wherein a moisture content of the liquid is 65 wt % or less, wherein the liquid inside the flow path is circulated between the inside and the outside of the flow path, and wherein in a case where a height of the flow path on an upstream side in a flow direction of the liquid within the flow path is H [μm], a length of the ejection orifice part in a direction in which the liquid is ejected from the ejection orifice is P [μm], and a length of the ejection orifice part in the flow direction of the liquid within the flow path is W [μm] in a communication part between the flow path and the ejection orifice part, $$H^{-0.34}\times p^{-0.66}\times w>1.5$$

is satisfied;

a recording element substrate in which the energy generating element is formed, wherein a pump, to circulate the liquid, is provided in the recording element substrate; and wherein the pump is a heat generating element that is provided separately from the energy generating element and generates a bubble in the liquid.

2. The liquid ejection head according to claim 1, wherein the moisture content of the liquid to be supplied is 60 wt % or less.

3. The liquid ejection head according to claim 1, wherein the moisture content of the liquid to be supplied is 55 wt % or less.

4. The liquid ejection head according to claim 1, wherein $H^{-0.34}\times P^{-0.66}\times W>1.7$ is satisfied.

5. The liquid ejection head according to claim 1, wherein the H is 20 or less, the P is 20 or less, and the W is 30 or less.

6. The liquid ejection head according to claim 1, wherein a velocity of a flow of the liquid within the flow path is 0.1 mm/s or more to 100 mm/s or less.

7. The liquid ejection head according to claim 1, wherein a solid content of the liquid to be supplied is 10 wt % or more.

8. The liquid ejection head according to claim 1, wherein the liquid to be supplied contains a self-dispersible pigment.

9. The liquid ejection head according to claim 1, further comprising a heating unit for heating the liquid to be supplied.

10. The liquid ejection head according to claim 1, further comprising a common liquid chamber that holds the liquid, wherein the flow path includes a pressure chamber including the energy generating element, a first flow path that allows the pressure chamber and the common liquid chamber to communicate with each other and a second flow path that allows the pressure chamber and the common liquid chamber to communicate with each other, and the pump is provided to the second flow path.

11. The liquid ejection head according to claim 10, wherein the second flow path has a substantial U shape including a bent part.

12. The liquid ejection head according to claim 1, wherein a pump, to cause the liquid to circulate, is provided outside the liquid ejection head.

13. The liquid ejection head according to claim 1, wherein the energy generating element is a heat generating element that generates a bubble in the liquid.

14. A liquid ejection apparatus comprising:

a liquid ejection head, the liquid ejection head including an ejection orifice for ejecting a liquid;

a flow path in which an energy generating element, which generates an energy to be used for ejecting the liquid, is disposed;

a liquid inside the flow path;

an ejection orifice part that allows the ejection orifice and the flow path to communicate with each other;

a supply flow path for supplying the liquid from the outside; and a recovery flow path for recovering the liquid to the outside, wherein a moisture content of the liquid is 65 wt % or less, wherein the liquid inside the flow path is circulated between the inside and the outside of the flow path, and wherein in a case where a height of the flow path on an upstream side in a flow direction of the liquid within the flow path is H [μm], a length of the ejection orifice part in a direction in which the liquid is ejected from the ejection orifice is P [μm], and a length of the ejection orifice part in the flow direction of the liquid within the flow path is W [μm] in a communication part between the flow path and the ejection orifice part, $$H^{-0.34} \times p^{-0.66} \times w > 1.5$$

is satisfied;

a recording element substrate in which the energy generating element is formed, wherein a pump, to circulate the liquid, is provided in the recording element substrate; and wherein the pump is a heat generating element that is provided separately from the energy generating element and generates a bubble in the liquid.

15. The liquid ejection apparatus according to claim 14, wherein the moisture content of the liquid to be supplied is 60 wt % or less.

16. The liquid ejection apparatus according to claim 14, wherein the moisture content of the liquid to be supplied is 55 wt % or less.

17. The liquid ejection apparatus according to claim 14, wherein $H^{-0.34} \times P^{-0.66} \times W > 1.7$ is satisfied.

* * * * *